US008674609B2

(12) United States Patent
Chiang et al.

(10) Patent No.: US 8,674,609 B2
(45) Date of Patent: Mar. 18, 2014

(54) TWO-TERMINAL CURRENT CONTROLLER AND RELATED LED LIGHTING DEVICE

(75) Inventors: Yung-Hsin Chiang, New Taipei (TW); Yi-Mei Li, New Taipei (TW)

(73) Assignee: IML International, Grand Cayman (KY)

( * ) Notice: Subject to any disclaimer, the term of this patent is extended or adjusted under 35 U.S.C. 154(b) by 35 days.

(21) Appl. No.: 13/584,836

(22) Filed: Aug. 14, 2012

(65) Prior Publication Data

US 2012/0306393 A1 Dec. 6, 2012

Related U.S. Application Data

(60) Continuation-in-part of application No. 13/532,797, filed on Jun. 26, 2012, now Pat. No. 8,319,443, which is a division of application No. 12/796,674, filed on Jun. 9, 2010, now Pat. No. 8,288,960.

(30) Foreign Application Priority Data

Apr. 15, 2010 (TW) ..... 99111804 A

(51) Int. Cl.
*H05B 39/00* (2006.01)

(52) U.S. Cl.
USPC ..... 315/185 S; 315/247; 315/291; 315/307; 315/312

(58) Field of Classification Search
USPC ..... 315/247, 246, 224, 225, 291, 307–326, 315/185 S
See application file for complete search history.

(56) References Cited

U.S. PATENT DOCUMENTS

| | | | |
|---|---|---|---|
| 6,227,679 | B1 | 5/2001 | Zhang |
| 7,683,553 | B2 | 3/2010 | Fong |
| 8,183,795 | B2 | 5/2012 | Huang |
| 2006/0267514 | A1 | 11/2006 | Xu |
| 2009/0322235 | A1 | 12/2009 | Shiu |
| 2011/0273112 | A1 | 11/2011 | Lee |
| 2011/0316441 | A1 | 12/2011 | Huynh |
| 2012/0139448 | A1 | 6/2012 | Chiang |

FOREIGN PATENT DOCUMENTS

| | | |
|---|---|---|
| TW | 200850048 | 12/2008 |
| TW | 201004471 | 1/2010 |

*Primary Examiner* — Tuyet Thi Vo

(74) *Attorney, Agent, or Firm* — Winston Hsu; Scott Margo

(57) ABSTRACT

An LED lighting device includes a first luminescent device for providing light according to a first current, a second luminescent device coupled in series to the first luminescent device for providing light according to a second current, an impedance device for limiting the second current within a predetermined range when a voltage established across the first luminescent device and the second luminescent device exceeds a first predetermined value, and a two-terminal current controller coupled in parallel with the first luminescent device and in series to the second luminescent device and configured to regulate the second current according to a voltage established across the two-terminal current controller.

17 Claims, 18 Drawing Sheets

TWO-TERMINAL CURRENT CONTROLLER AND RELATED LED LIGHTING DEVICE

CROSS REFERENCE TO RELATED APPLICATIONS

This is a continuation-in-part of U.S. application Ser. No. 13/532,797 filed on Jun. 26, 2012, which is a division of application Ser. No. 12/796,674 filed on 9 Jun. 2010, the entirety of which is incorporated by reference.

BACKGROUND OF THE INVENTION

1. Field of the Invention

The present invention is related to a light-emitting diode lighting device, and more particularly, to a light-emitting diode lighting device with overvoltage protection.

2. Description of the Prior Art

Compared to traditional incandescent bulbs, light-emitting diodes (LEDs) are advantageous in low power consumption, long lifetime, small size, no warm-up time, fast reaction speed, and the ability to be manufactured as small or array devices. In addition to outdoor displays, traffic signs, and LCD backlight for various electronic devices such as mobile phones, notebook computers or personal digital assistants (PDAs), LEDs are also widely used as indoor/outdoor lighting devices in place of fluorescent of incandescent lamps.

FIG. 1 is a diagram illustrating the voltage-current chart of a light-emitting diode. When the forward-bias voltage of the light-emitting diode is smaller than its barrier voltage Vb, the light-emitting diode functions as an open-circuited device since it only conducts a negligible amount of current. When the forward-bias voltage of the light-emitting diode exceeds its barrier voltage Vb, the light-emitting diode functions as a short-circuited device since its current increases exponentially with the forward-bias voltage. The barrier voltage Vb, whose value is related to the material and doping type of the light-emitting diode, is typically between 1.5 and 3 volts. For most current values, the luminescence of the light-emitting diode is proportional to the current. Therefore, a current source is generally used for driving light-emitting diodes in order to provide uniform luminescence.

FIG. 2 is a diagram of a prior art LED lighting device 950. The LED lighting device 950 includes a power supply circuit 110, a resistor R and a luminescent device 10. The power supply circuit 110 is configured to receive an alternative-current (AC) voltage VS having positive and negative periods and convert the output of the AC voltage VS in the negative period using a bridge rectifier 112, thereby providing a rectified AC voltage $V_{AC}$, whose value varies periodically with time, for driving the luminescent device 10. The resistor R is coupled in series with the luminescent device 10 for regulating its current $I_{LED}$. In many applications, multiple light-emitting diodes are required in order to provide sufficient brightness. Since a light-emitting diode is a current-driven device whose luminescence is proportional to its driving current, the luminescent device 10 normally adopts a plurality of light-emitting diodes $D_1$-$D_n$ coupled in series. Assuming that the barrier voltage of all the light-emitting diodes $D_1$-$D_n$ is equal to the ideal value Vb and the rectified AC voltage $V_{AC}$ varies between 0 and $V_{MAX}$ with time, a forward-bias voltage larger than n*Vb is required for turning on the luminescent device 10. Therefore, the energy between 0 and n*Vb cannot be used. As the number of the light-emitting diodes $D_1$-$D_n$ increases, a higher forward-bias voltage is required for turning on the luminescent device 10, thereby reducing the effective operational voltage range of the LED lighting device 950; as the number of the light-emitting diodes $D_1$-$D_n$ decreases, the large driving current when $V_{AC}=V_{MAX}$ may impact the reliability of the light-emitting diodes. Therefore, the prior art LED lighting device 950 needs to make compromise between the effective operational voltage range and the reliability. Meanwhile, the current-limiting resistor R also consumes extra power and may thus lower system efficiency.

FIG. 3 is a diagram of another prior art LED lighting device 960. The LED lighting device 960 includes a power supply circuit 110, an inductor L, a capacitor C, a switch SW, and a luminescent device 10. The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the luminescent device 10. The inductor L and the switch SW are coupled in series with the luminescent device 10 for limiting its current $I_{LED}$. The capacitor C is coupled in parallel to the luminescent device 10 for absorbing voltage ripples of the power supply circuit 110. For the same current-regulating function, the inductor L consumes less energy than the resistor R of the LED lighting device 950. However, the inductor L for regulating current and the capacitor for stabilizing voltage largely reduce the power factor of the LED lighting device 960 and the energy utilization ratio. Therefore, the prior art LED lighting device 960 needs to make compromise between the effective operational voltage range and the brightness. Also, the inductor L, the capacitor C and the switch SW may occupy large space and require separate assembly steps.

SUMMARY OF THE INVENTION

The present invention provides an LED lighting device with overvoltage protection. The LED lighting device includes a first luminescent device for providing light according to a first current, a second luminescent device coupled in series to the first luminescent device for providing light according to a second current, a first impedance device for limiting the first current or the second current within a first predetermined range when a voltage established across the first luminescent device and the second luminescent device exceeds a first predetermined value, and a first two-terminal current controller coupled in parallel to the first luminescent device and in series to the second luminescent device and configured to regulate the second current according to a voltage established across the two-terminal current controller. During a rising period of a rectified AC voltage when the voltage established across the first luminescent device does not exceed a first voltage, the first two-terminal current controller operates in a first mode. During the rising period when the voltage established across the first luminescent device exceeds the first voltage but does not exceed a second voltage, the first two-terminal current controller operates in a second mode. During the rising period when the voltage established across the first luminescent device exceeds the second voltage, the first two-terminal current controller operates in a third mode. The first two-terminal current controller includes a current limiting unit configured to conduct a third current associated with the rectified AC voltage, regulate the third current according to the voltage established across the first luminescent device and maintain the first current at zero when the first two-terminal current controller operates in the first mode, conduct the third current, maintain the third current at a second predetermined value larger than zero and maintain the first current at zero when the first two-terminal current controller operates in the second mode, and switch off for equalizing the first current and the second current when the first two-terminal current controller operates in the third mode.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
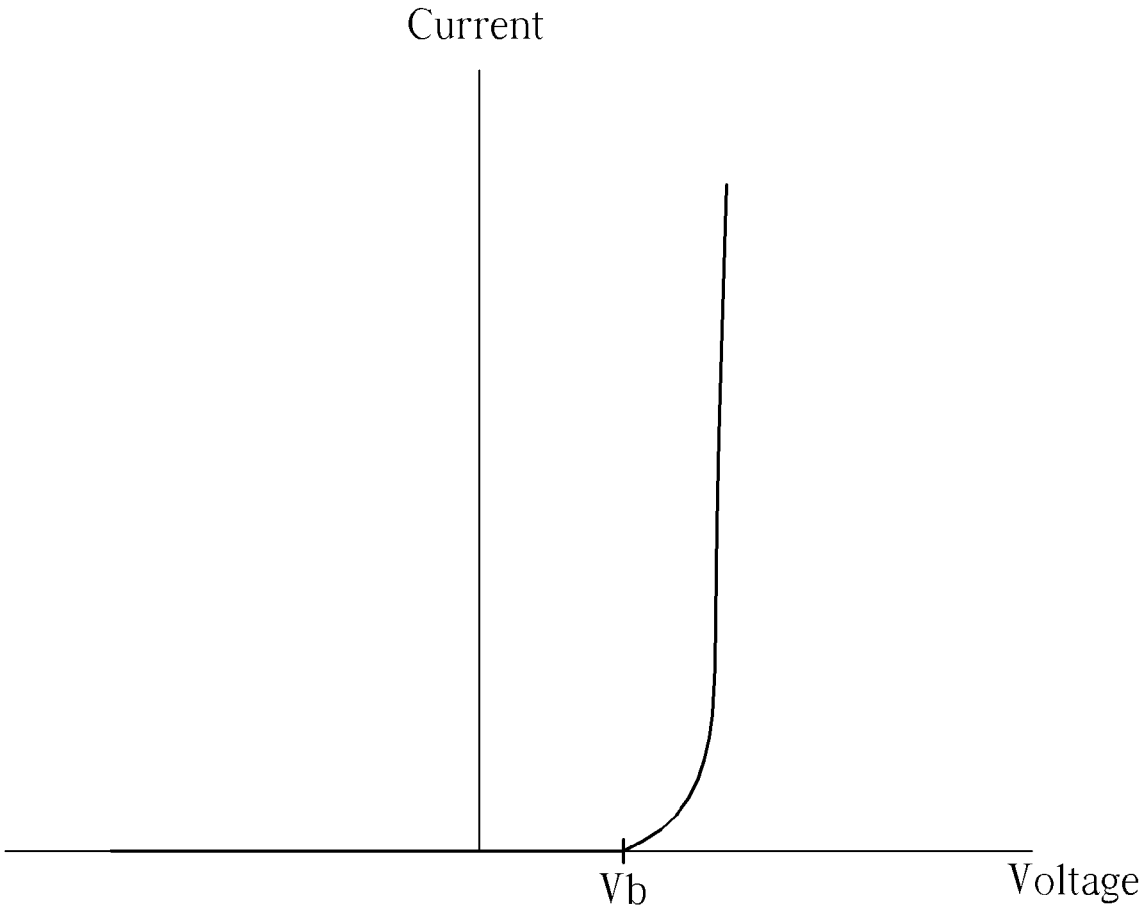
FIG. 1 PRIOR ART
FIG. 1 is a diagram illustrating the voltage-current chart of a light-emitting diode.
Figure 2:
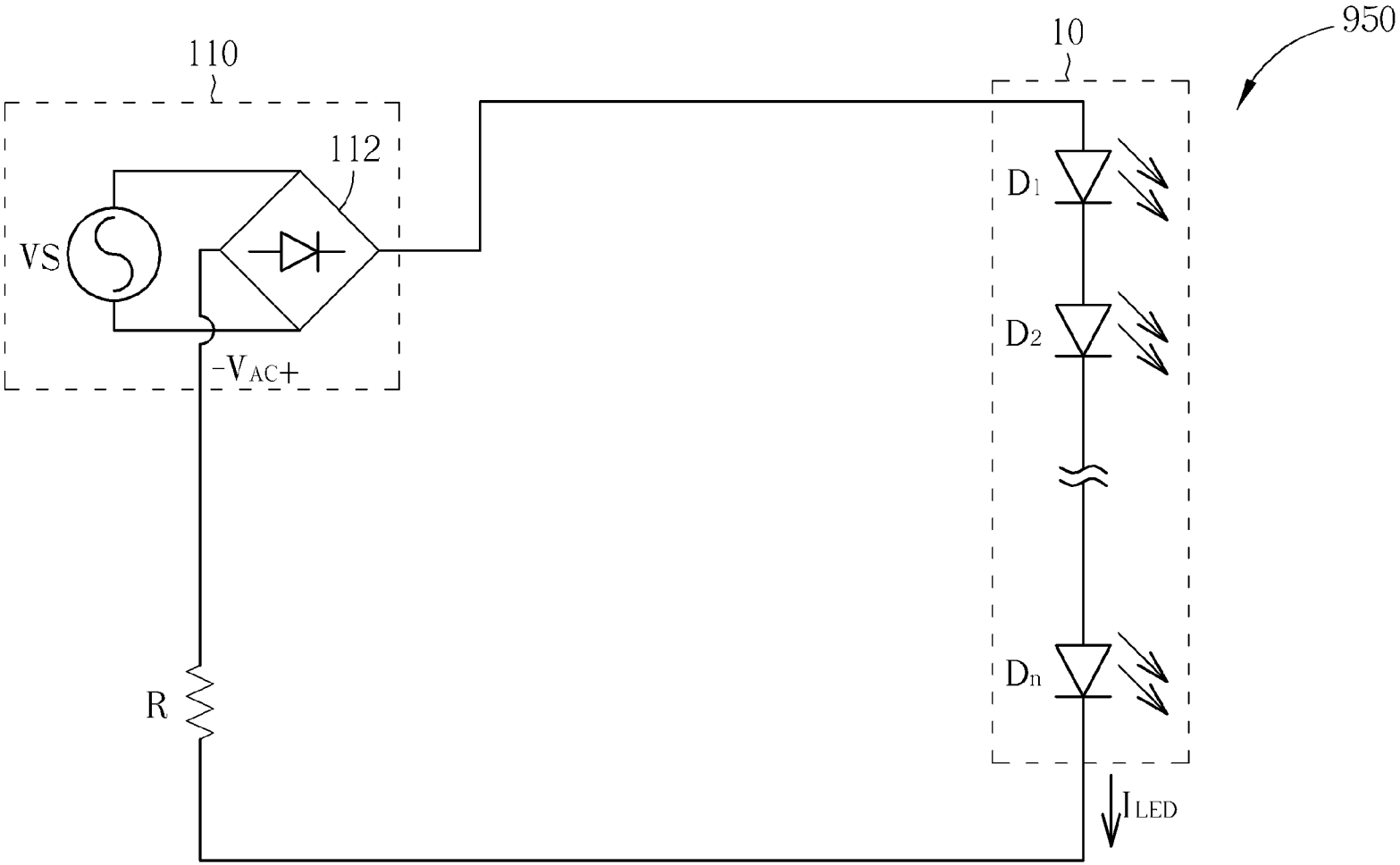
FIG. 2 PRIOR ART
FIG. 2 is a diagram of a prior art LED lighting device.
Figure 3:
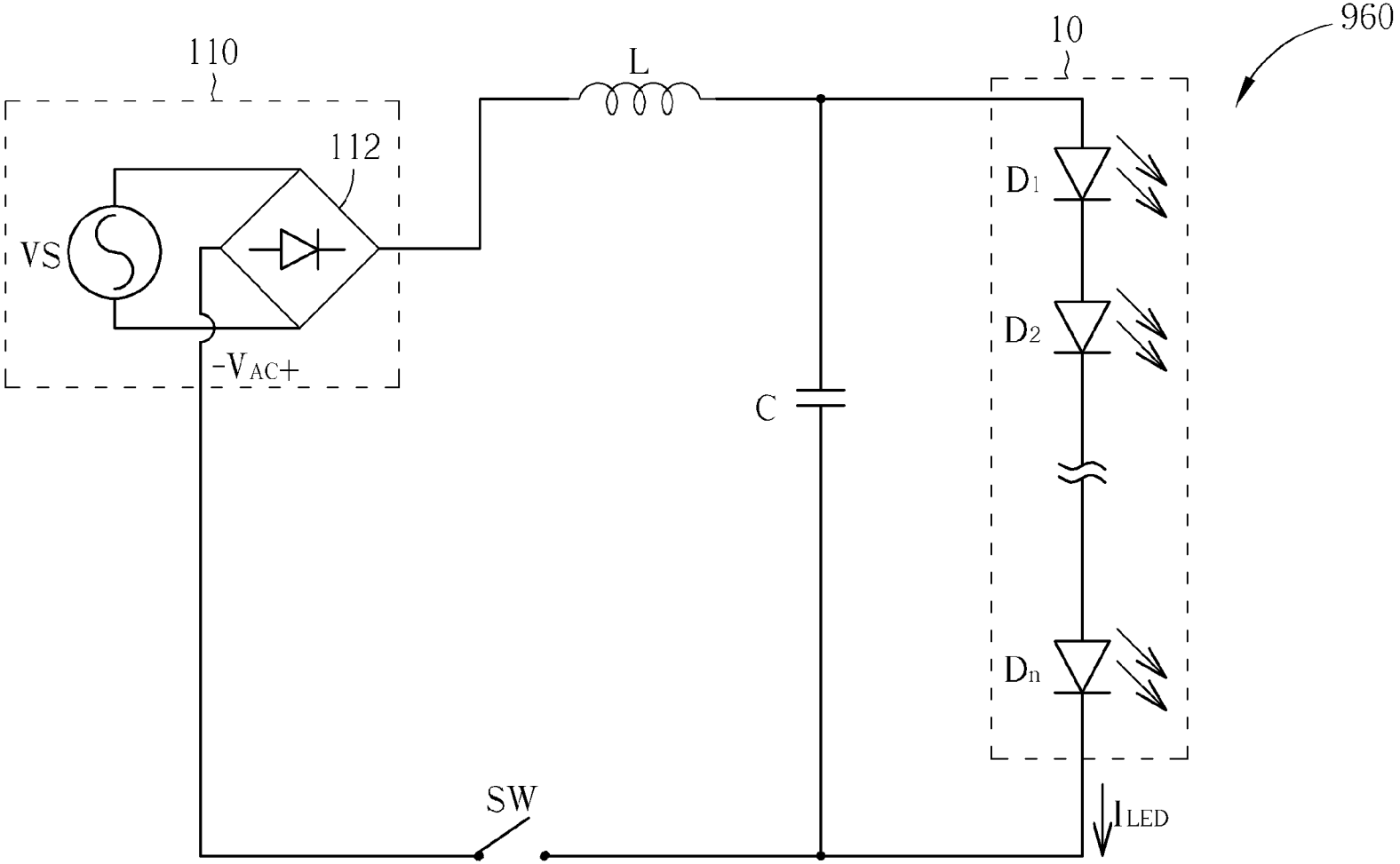
FIG. 3 PRIOR ART
FIG. 3 is a diagram of another prior art LED lighting device.
Figure 4:
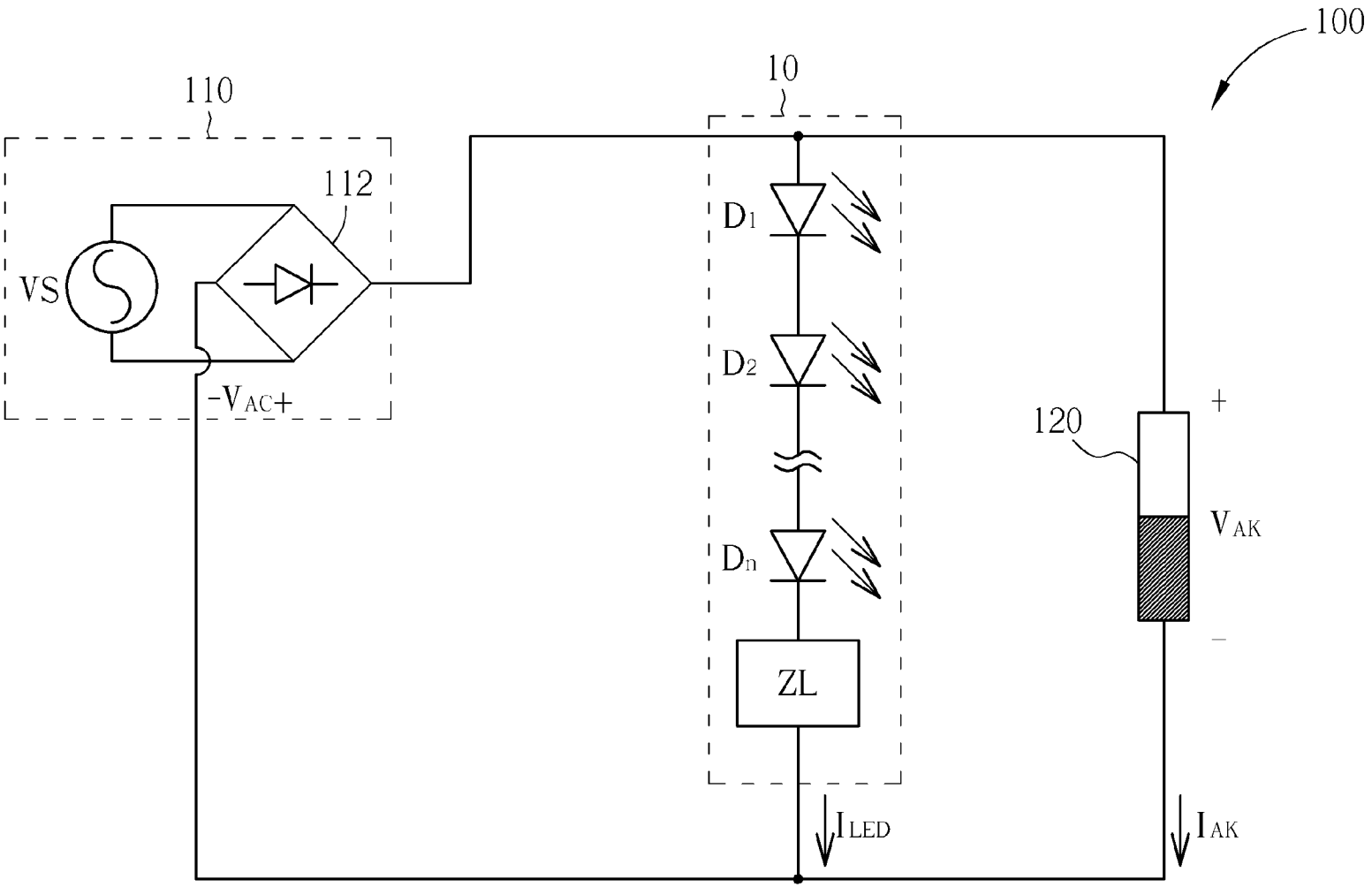
FIGS. 4-5, 9-10, 13-16 and 18 are diagram of LED lighting devices according to embodiments of the present invention.
Figure 5:
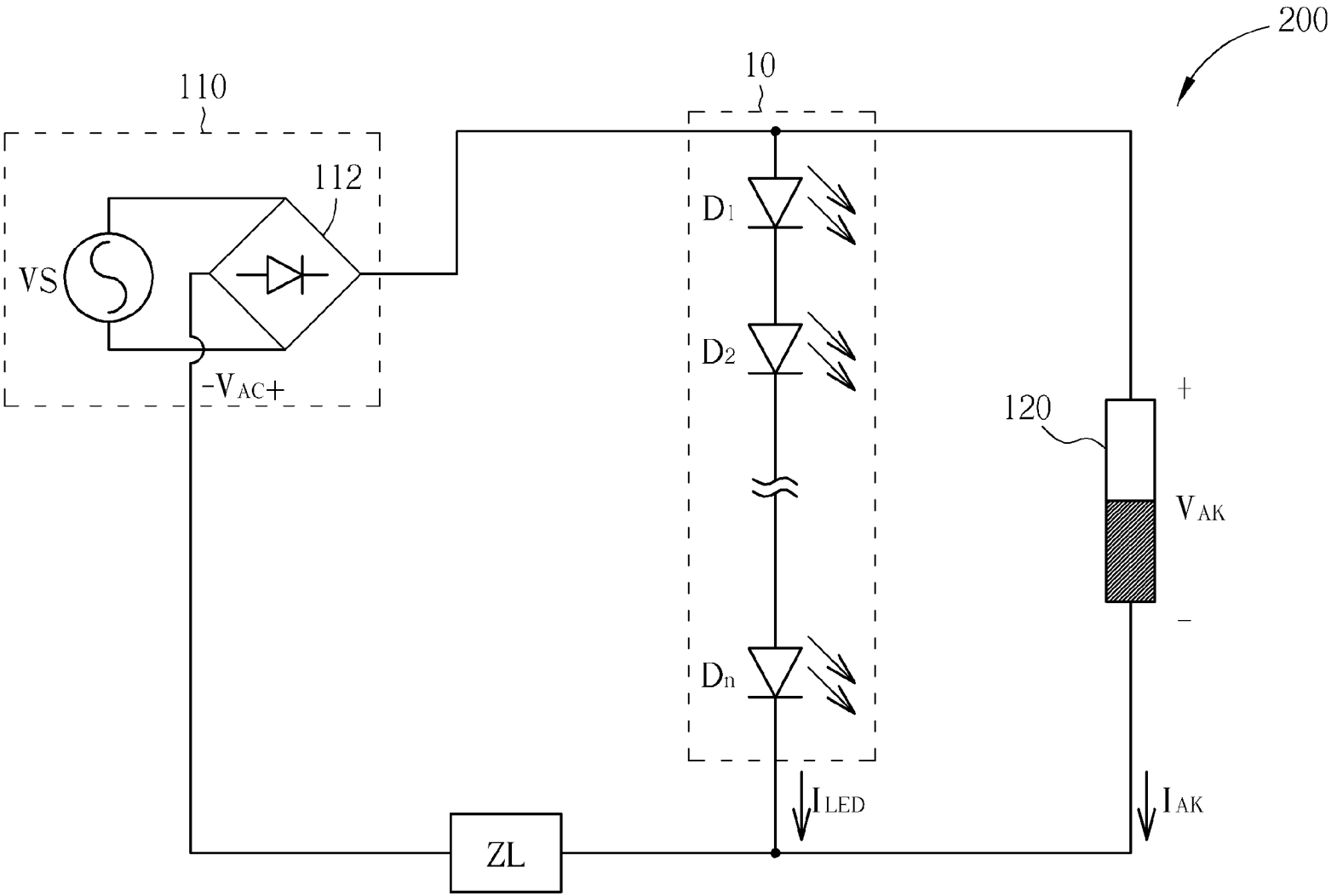

FIG. 4 is a diagram of an LED lighting device 100 according to a first embodiment of the present invention. FIG. 5 is a diagram of an LED lighting device 200 according to a second embodiment of the present invention. Each of the LED lighting devices 100 and 200 includes a power supply circuit 110, a two-terminal current controller 120, a luminescent device 10 and an impedance device ZL. The power supply circuit 110 is configured to receive an AC voltage VS having positive and negative periods and convert the output of the AC voltage VS in the negative period using a bridge rectifier 112, thereby providing a rectified AC voltage $V_{AC}$, whose value varies periodically with time, for driving the luminescent device 10. The luminescent device 10 may adopt n light-emitting units $D_1$-$D_n$ coupled in series, each of which may include a single light-emitting diode or multiple light-emitting diodes. FIGS. 4 and 5 depict the embodiment using a single light-emitting diode, but do not limit the scope of the present invention. $I_{LED}$ represents the current passing through the luminescent device 10 and $V_{AK}$ represents the voltage established across the luminescent device 10. The two-terminal current controller 120, coupled in parallel to the luminescent device 10 and the power supply circuit 110, is configured to control the current $I_{LED}$ passing through the luminescent device 10 according to the rectified AC voltage $V_{AC}$, wherein $I_{AK}$ represents the current passing through the two-terminal current controller 120. In the first and second embodiments of the present invention, the barrier voltage Vb' of the two-terminal current controller 120 is smaller than the overall barrier voltage n*Vb of the luminescent device 10 (assuming the barrier voltage of each light-emitting unit is equal to Vb).

In the LED lighting device 100 according to the first embodiment of the present invention, the two-terminal current controller 120 is coupled in parallel to the serially-coupled impedance device ZL and the luminescent device 10. In the LED lighting device 200 according to the second embodiment of the present invention, the impedance device ZL is coupled in series to the luminescent device 10 and the two-terminal current controller 120. The impedance device ZL may include a resistor, a capacitor, any device providing a resistive path, or any combination thereof. When the power supply circuit 110 somehow fluctuates and the rectified AC voltage $V_{AC}$ is raised above its upper design limit, the impedance device ZL may provide overvoltage protection to the luminescent device 10.

Figure 6:
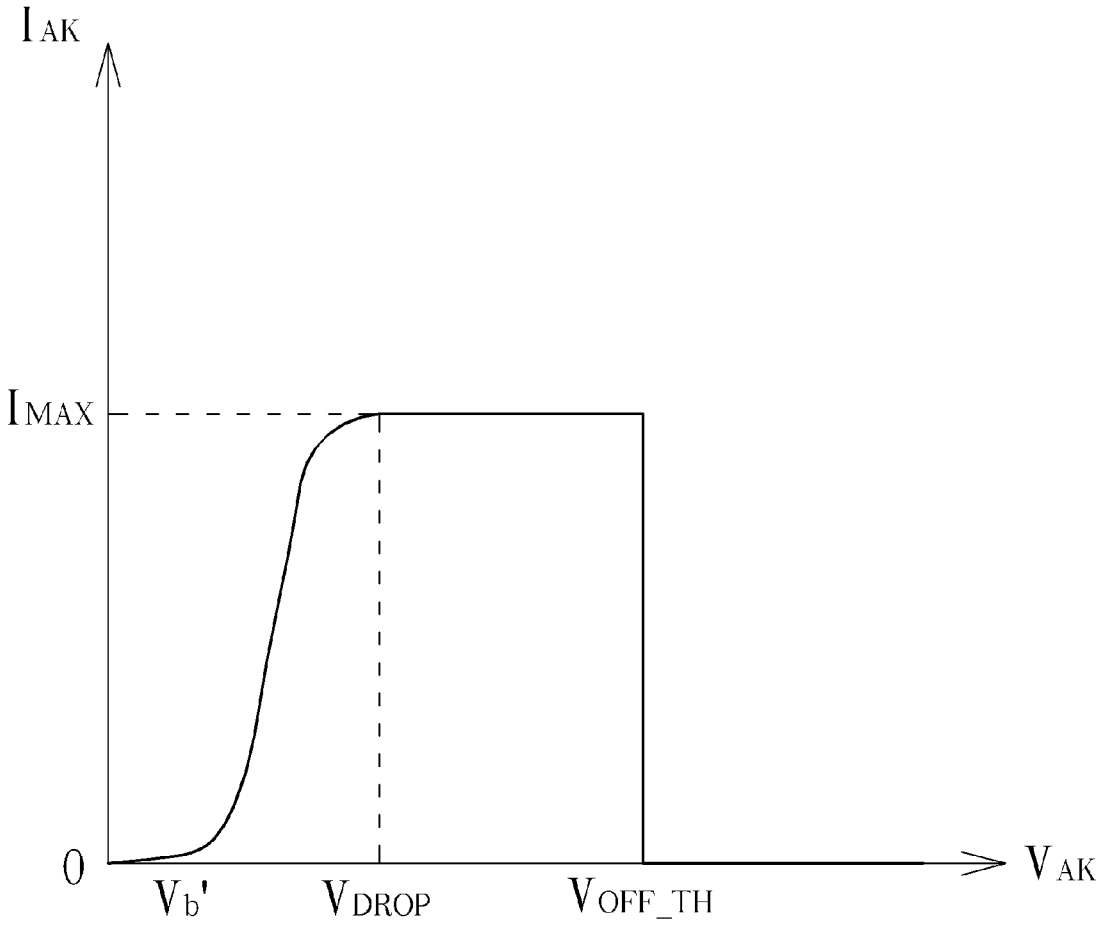
FIGS. 6 and 11 are diagrams illustrating the current-voltage chart of a two-terminal current controller according to the present invention.
Figure 7:
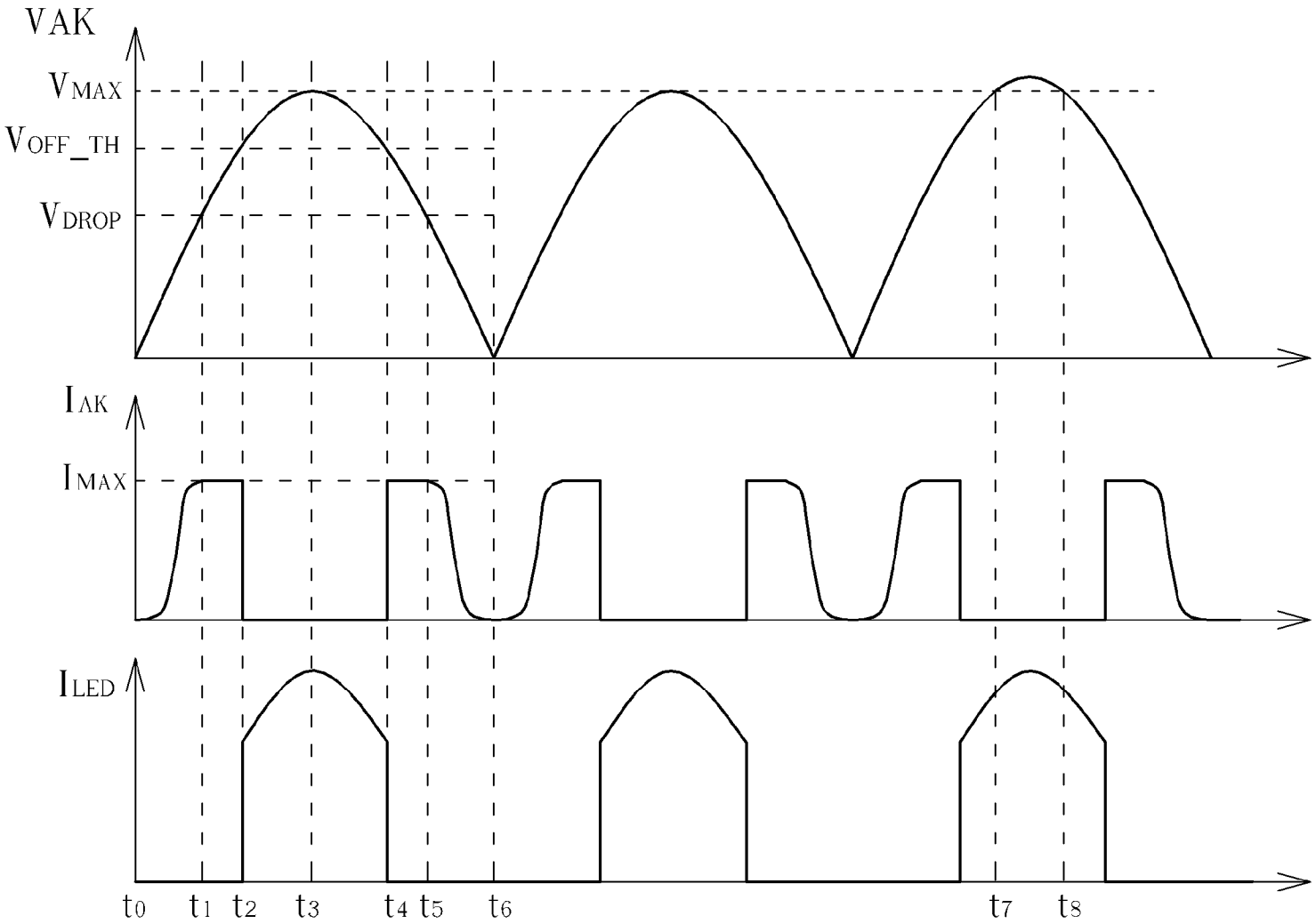
FIGS. 7 and 12 are diagrams illustrating the variations in the related current and voltage when operating the LED lighting device of the present invention.

FIGS. 6 and 7 illustrate the operation of the LED lighting devices 100 and 200, wherein FIG. 6 is a diagram illustrating the current-voltage chart of the two-terminal current controller 120, and FIG. 7 is a diagram illustrating the variations in the related current and voltage when operating the LED lighting devices 100 and 200. In FIG. 6, the vertical axis represents the current $I_{AK}$ passing through the two-terminal current controller 120, and the horizontal axis represents the voltage $V_{AK}$ established across the two-terminal current controller 120. In the first and second embodiments of the present invention, the two-terminal current controller 120 operates in a first mode and functions as a voltage-controlled device when $0<V_{AK}<V_{DROP}$. In other words, when the voltage $V_{AK}$ exceeds the barrier voltage Vb' of the two-terminal current controller 120, the current $I_{AK}$ changes with the voltage $V_{AK}$ in a specific manner; the two-terminal current controller 120 operates in a second mode and functions as a constant current source when $V_{DROP}<V_{AK}<V_{OFF_TH}$. In other words, the current $I_{AK}$ is maintained at a maximum current $I_{MAX}$ instead of changing with the voltage $V_{AK}$; the two-terminal current controller 120 functions in a third mode and is turned off when $V_{AK}>V_{OFF_TH}$. In other words, the two-terminal current controller 120 functions as an open-circuited device since the current $I_{AK}$ is suddenly reduced to zero.

FIG. 7 illustrates the waveforms of the voltage $V_{AK}$, the current $I_{AK}$ and the current $I_{LED}$. Since the voltage $V_{AK}$ is associated with the rectified AC voltage $V_{AC}$ whose value varies periodically with time, a cycle between $t_0$-$t_6$ is used for illustration, wherein the period between $t_0$-$t_3$ is the rising period of the rectified AC voltage $V_{AC}$ and the period between $t_3$-$t_6$ is the falling period of the rectified AC voltage $V_{AC}$. Between $t_0$-$t_1$ when the voltage $V_{AK}$ gradually increases, the two-terminal current controller 120 is first turned on, after which the current $I_{AK}$ increases with the voltage $V_{AK}$ in a specific manner and the current $I_{LED}$ is maintained at substantially zero. Between $t_1$-$t_2$ when the voltage $V_{AK}$ is larger than the voltage $V_{DROP}$, the two-terminal current controller 120 is configured to limit the current $I_{AK}$ to the maximum current $I_{MAX}$, and the current $I_{LED}$ remains substantially zero since the luminescent device 10 is still turned off. Between $t_2$-$t_4$ when the voltage $V_{AK}$ is larger than the voltage $V_{OFF_TH}$, the two-terminal current controller 120 is turned off and the current associated with the rectified AC voltage $V_{AC}$ thus flows through the luminescent device 10. Therefore, the current $I_{AK}$ is reduced to zero, and the current $I_{LED}$ changes with the voltage $V_{AK}$. Between $t_4$-$t_5$ when the voltage $V_{AK}$ drops to a value between the voltage $V_{DROP}$ and the voltage $V_{OFF_TH}$, the two-terminal current controller 120 is turned on, thereby limiting the current $I_{AK}$ to the maximum current $I_{MAX}$ and maintaining the current $I_{LED}$ at substantially zero. Between $t_5$-$t_6$ when the voltage $V_{AK}$ drops below the voltage $V_{DROP}$, the current $I_{AK}$ decreases with the voltage $V_{AK}$ in a specific manner.

If the power supply circuit 110 somehow fluctuates and the rectified AC voltage $V_{AC}$ is raised above its upper design limit $V_{MAX}$ (such as during $t_7$-$t_8$), this overvoltage may cause overcurrent to damage the luminescent device 10 and may create extra heat. In the present invention, the impedance device ZL may function as a current limiter capable of preventing the luminescent device 10 from possible damages due to overcurrent and improving heat dissipation.

Figure 8:
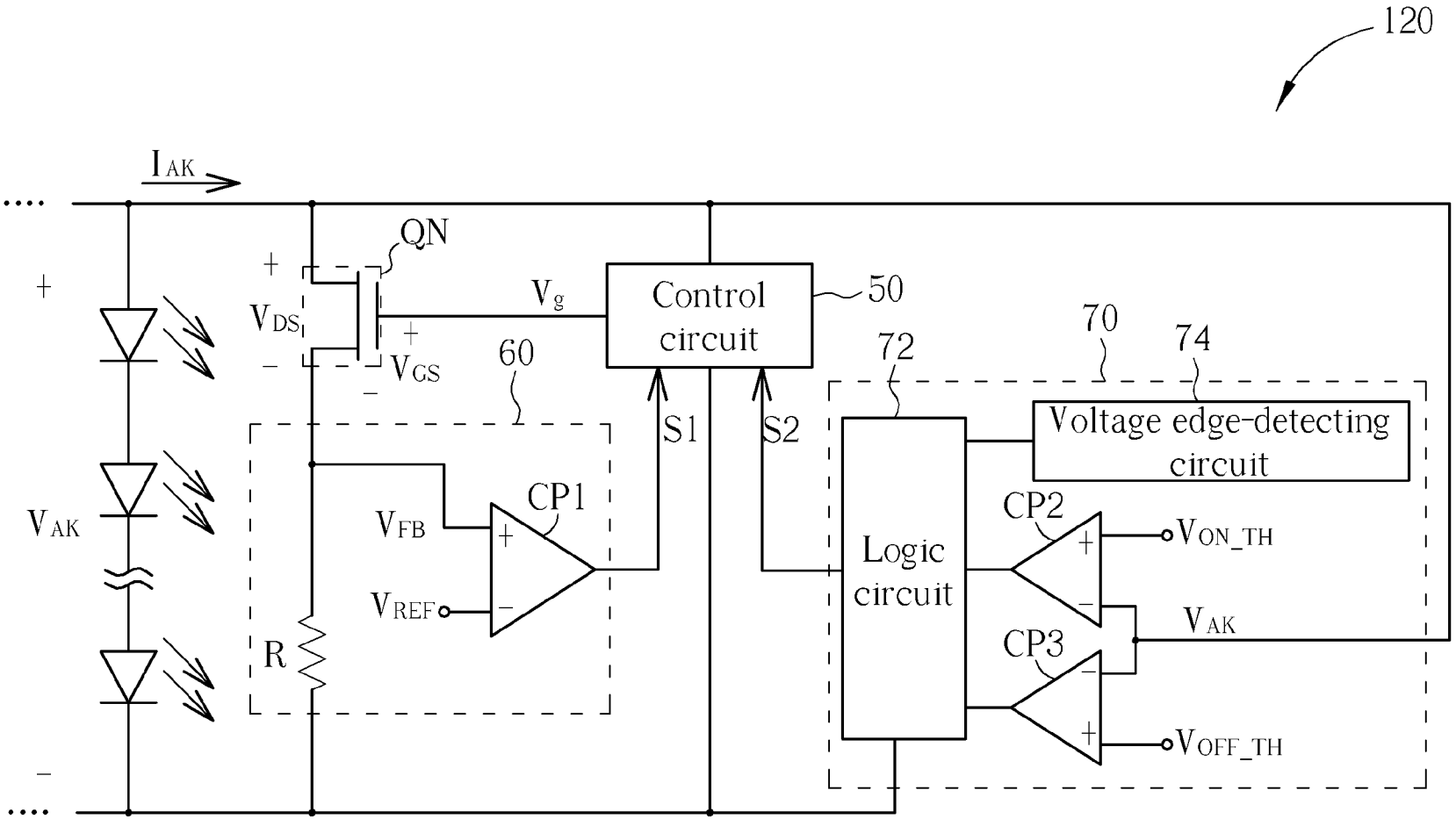
FIG. 8 is a diagram of an illustrated embodiment of the two-terminal current controller.

FIG. 8 is a diagram of an illustrated embodiment of the two-terminal current controller 120. In this embodiment, the two-terminal current controller 120 includes a switch QN, a control circuit 50, a current-detecting circuit 60, and a voltage-detecting circuit 70. The switch QN may include a field effect transistor (FET), a bipolar junction transistor (BJT) or other devices having similar function. In FIG. 5, an N-type metal-oxide-semiconductor (NMOS) transistor is used for illustration, but does not limit the scope of the present invention. With the gate coupled to the control circuit 50 for receiving a turn-on voltage $V_g$, the drain-to-source voltage, the gate-to-source voltage and the threshold voltage of the switch QN are represented by $V_{DS}$, $V_{GS}$ and $V_{TH}$, respectively. When the switch QN operates in the linear region, its drain current is mainly determined by the drain-to-source voltage $V_{DS}$; when the switch QN operates in the saturation region, its drain current is only related to the gate-to-source voltage $V_{GS}$.

During the rising period of the rectified AC voltage $V_{AC}$, the drain-to-source voltage $V_{DS}$ of the switch QN increases with the voltage $V_{AK}$. When the voltage $V_{AK}$ does not exceed $V_{DROP}$, the drain-to-source voltage $V_{DS}$ is smaller than the difference between the gate-to-source voltage $V_{GS}$ and the threshold voltage $V_{TH}$ ($V_{DS}<V_{GS}-V_{TH}$). The turn-on voltage $V_g$ from the control circuit 50 provides a bias condition $V_{GS}>V_{TH}$ which allows the switch QN to operate in the linear region where the drain current is mainly determined by the drain-to-source voltage $V_{DS}$. In other words, the two-terminal current controller 120 is configured to provide the current $I_{AK}$ and voltage $V_{AK}$ whose relationship corresponds to the I-V characteristic of the switch QN when operating in the linear region.

During the rising period of the rectified AC voltage $V_{AC}$ when the voltage $V_{AK}$ falls between $V_{DROP}$ and $V_{OFF_TH}$, the drain-to-source voltage $V_{DS}$ is larger than the difference between the gate-to-source voltage $V_{GS}$ and the threshold voltage $V_{TH}$ ($V_{DS}>V_{GS}-V_{TH}$). The turn-on voltage $V_g$ from the control circuit 50 provides a bias condition $V_{GS}>V_{TH}$ which allows the switch QN to operate in the saturation region where the drain current is only related to the gate-to-source voltage $V_{GS}$ and the current $I_{AK}$ no longer varies with the voltage $V_{AK}$. In the present invention, the current-detecting circuit 60 is configured to detect the current flowing through the switch QN and determine whether the corresponding voltage $V_{AK}$ exceeds $V_{DROP}$. In the embodiment depicted in FIG. 8, the current-detecting circuit 60 includes a resistor R and a comparator CP1. The resistor R is used for providing a feedback voltage $V_{FB}$ which is associated with the current passing the switch QN. The comparator CP1 is configured to output a corresponding control signal S1 to the control circuit 50 according to the relationship between the feedback voltage $V_{FB}$ and a reference voltage $V_{REF}$. If $V_{FB}>V_{REF}$, the control circuit 50 maintains the gate-to-source voltage $V_{GS}$ to a predetermined value which is larger than the threshold voltage $V_{TH}$, thereby limiting the current $I_{AK}$ to $I_{MAX}$.

The voltage-detecting circuit 70 includes a logic circuit 72, a voltage edge-detecting circuit 74, and two comparators CP2 and CP3. The comparator CP2 is configured to determine the relationship between the voltages $V_{AK}$ and $V_{ON_TH}$, while the comparator CP3 is configured to determine the relationship between the voltages $V_{AK}$ and $V_{OFF_TH}$. Meanwhile, when the voltages $V_{AK}$ is between $V_{OFF_TH}$ and $V_{ON_TH}$, the voltage edge-detecting circuit 74 is configured to determine whether the rectified AC voltage $V_{AC}$ is during the rising period or during the falling period. Based on the results of the voltage edge-detecting circuit 74 and the comparators CP2 and CP3, the logic circuit 72 outputs a corresponding control signal S2 to the control circuit 50. During the rising period of the rectified AC voltage $V_{AC}$ when the voltage $V_{AK}$ is between $V_{OFF_TH}$ and $V_{ON_TH}$, the control circuit 50 keeps the turn-on voltage $V_g$ smaller than the threshold voltage $V_{ON_TH}$ according to the control signal S2, thereby turning off the switch QN and maintaining the current $I_{AK}$ at zero. During the falling period of the rectified AC voltage $V_{AC}$ when the voltage $V_{AK}$ is between $V_{ON_TH}$ and $V_{OFF_TH}$, the control circuit 50 keeps the turn-on voltage $V_g$ larger than the threshold voltage $V_{ON_TH}$ according to the control signal S2, thereby operating the switch QN in the saturation region and maintaining the current $I_{AK}$ at $I_{MAX}$.

Figure 9:
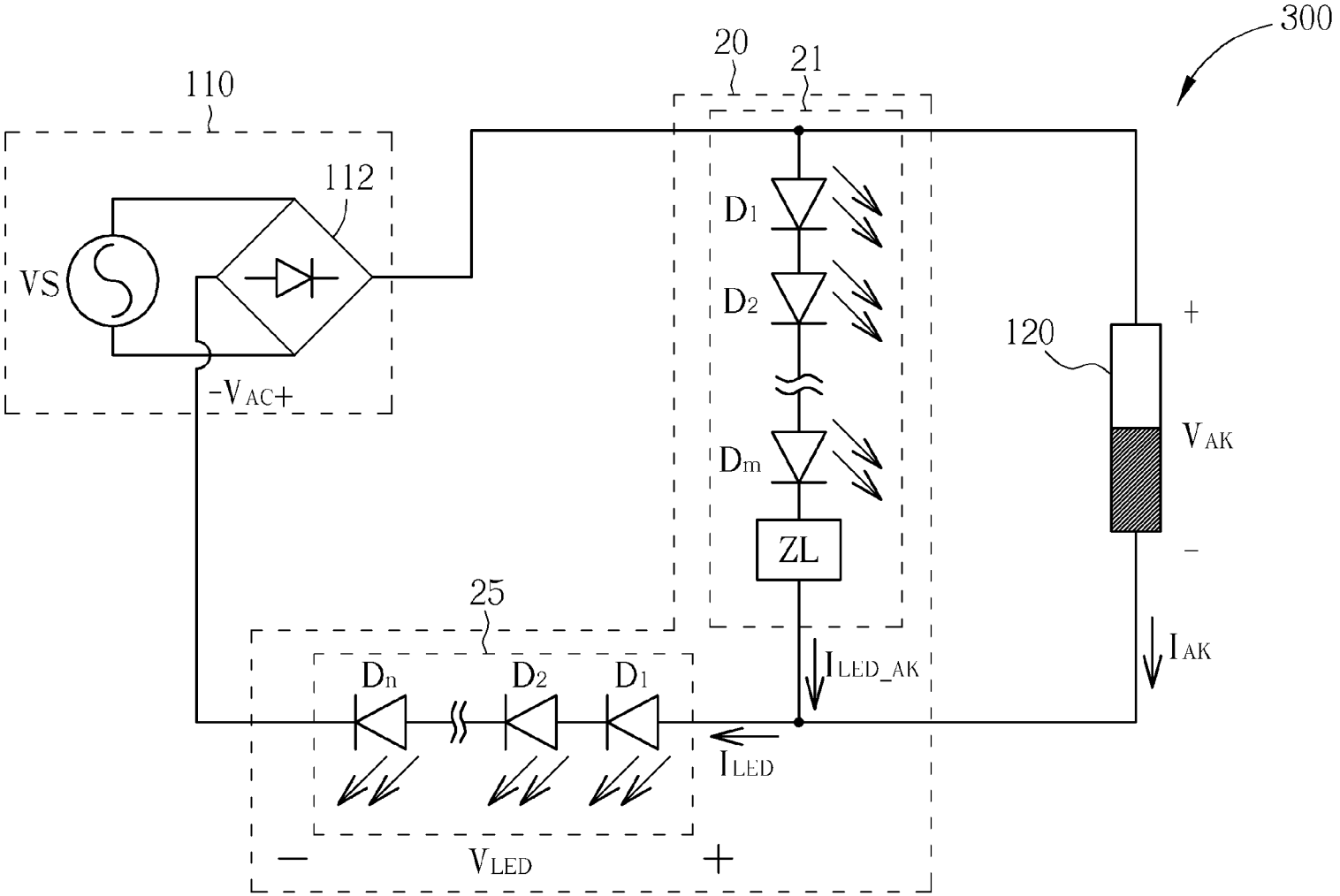
Figure 10:
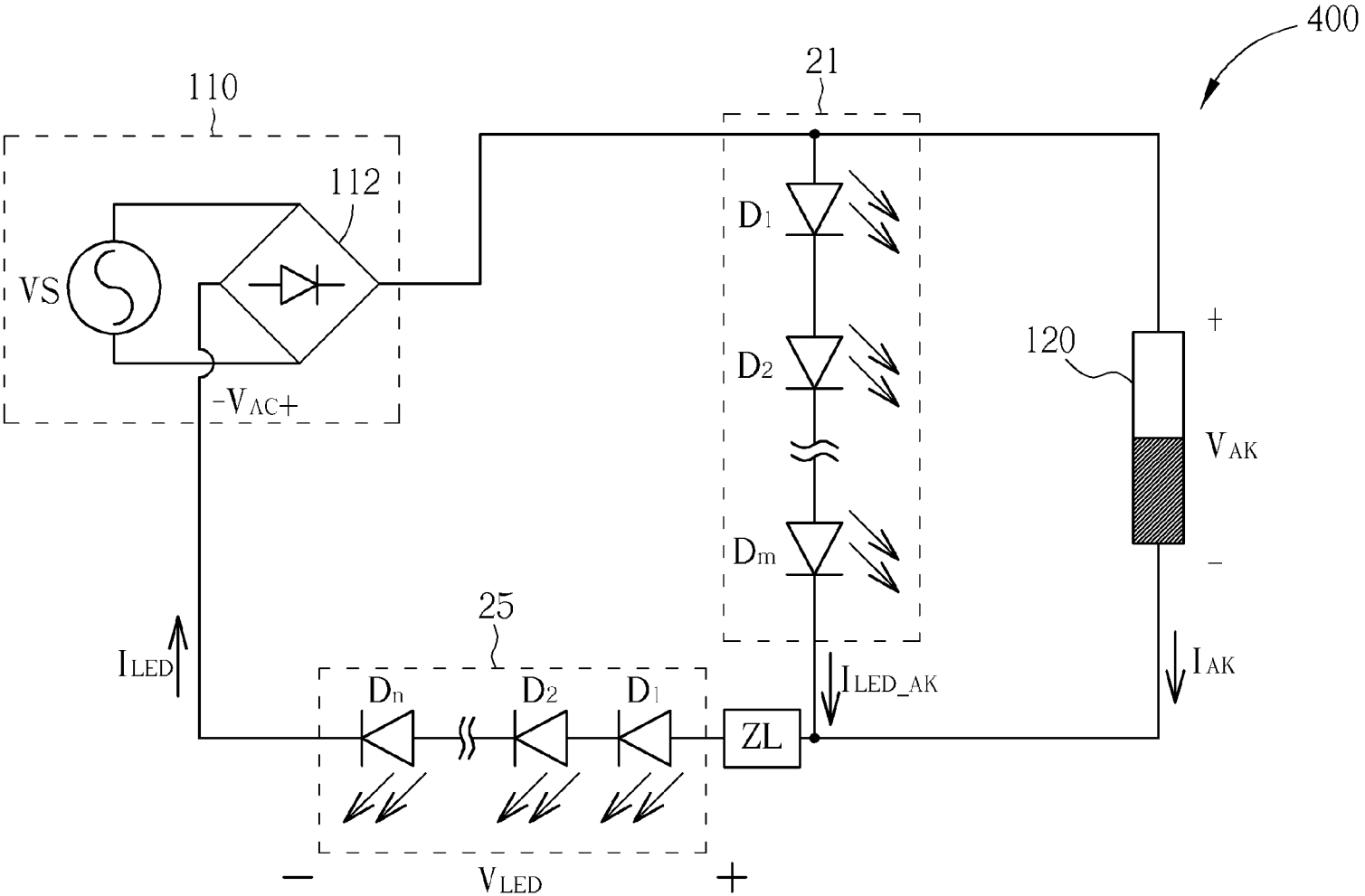

FIG. 9 is a diagram of an LED lighting device 300 according to a third embodiment of the present invention. FIG. 10 is a diagram of an LED lighting device 400 according to a fourth embodiment of the present invention. Each of the LED lighting devices 300 and 400 includes a power supply circuit 110, a two-terminal current controller 120, two luminescent devices 21 and 25, and an impedance device ZL.

In the LED lighting device 300 according to the third embodiment of the present invention, the two-terminal current controller 120 is coupled in parallel to the serially-coupled impedance device ZL and the luminescent device 21. The luminescent device 21 includes m light-emitting units $D_1$-$D_m$ coupled in series, wherein $I_{LED}$ represents the current flowing through the luminescent device 21 and $V_{AK}$ represents the voltage established across the luminescent device 21 and the impedance device ZL. The luminescent device 25 is coupled in series to the two-terminal current controller 120 and includes n light-emitting units $D_1$-$D_n$ coupled in series, wherein $I_{LED_AK}$ represents the current flowing through the luminescent device 25 and $V_{LED}$ represents the voltage established across the luminescent device 25. The barrier voltage Vb' of the two-terminal current controller 120 is smaller than the overall barrier voltage m*Vb of the luminescent device 21 (assuming the barrier voltage of each luminescent element is equal to Vb). Each light-emitting unit may include a single light-emitting diode or multiple light-emitting diodes. FIG. 9 depicts the embodiment using a single light-emitting diode, but does not limit the scope of the present invention.

In the LED lighting device 400 according to the fourth embodiment of the present invention, the impedance device ZL is coupled in series to the luminescent devices 21, 25 and the two-terminal current controller 120. The luminescent device 21 includes m light-emitting units $D_1$-$D_m$ coupled in series, wherein $I_{LED_AK}$ represents the current flowing through the luminescent device 21 and $V_{AK}$ represents the voltage established across the luminescent device 21. The luminescent device 25 is coupled in series to the two-terminal current controller 120 and includes n light-emitting units $D_1$-$D_n$ coupled in series, wherein $I_{LED}$ represents the current flowing through the luminescent device 25 and $V_{LED}$ represents the voltage established across the luminescent device 25. The barrier voltage Vb' of the two-terminal current controller 120 is smaller than the overall barrier voltage m*Vb of the luminescent device 21 (assuming the barrier voltage of each luminescent element is equal to Vb). Each light-emitting unit may include a single light-emitting diode or multiple light-emitting diodes. FIG. 10 depicts the embodiment using a single light-emitting diode, but does not limit the scope of the present invention.

Figure 11:
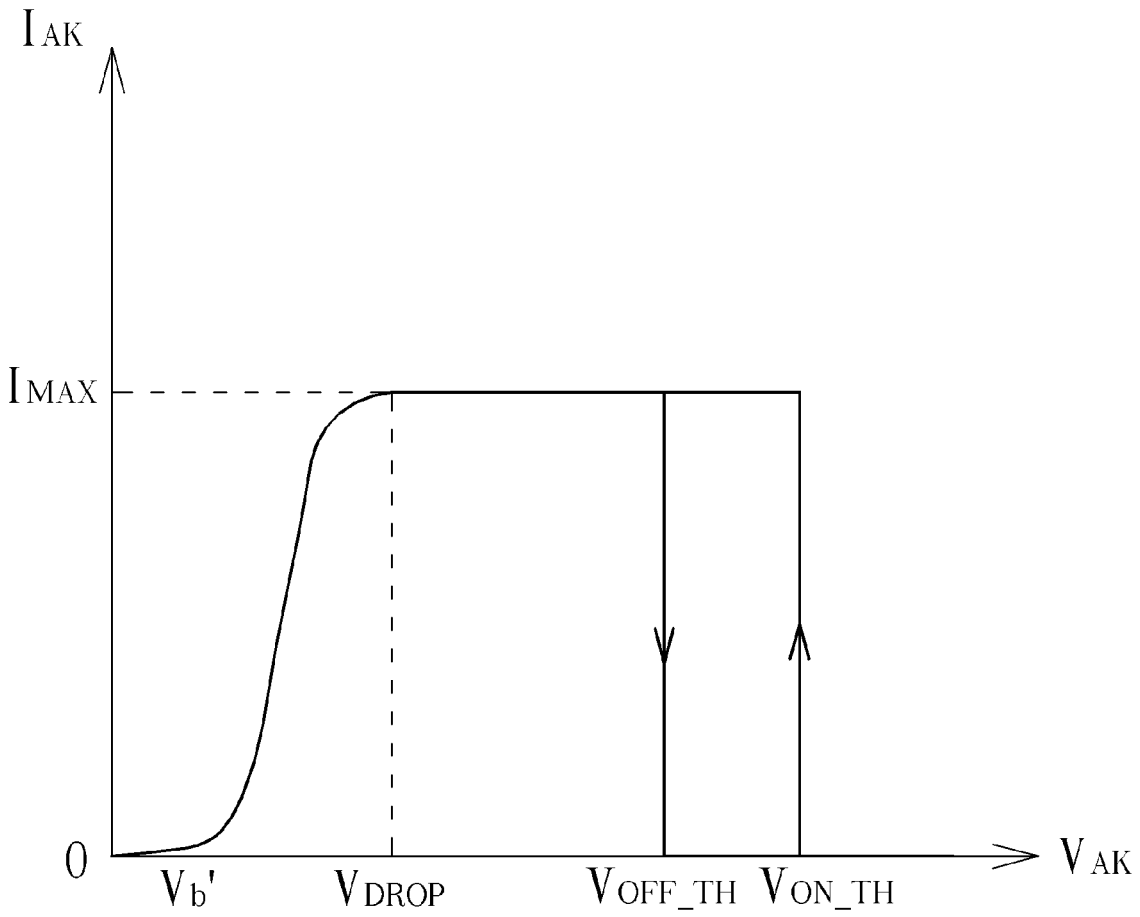
Figure 12:
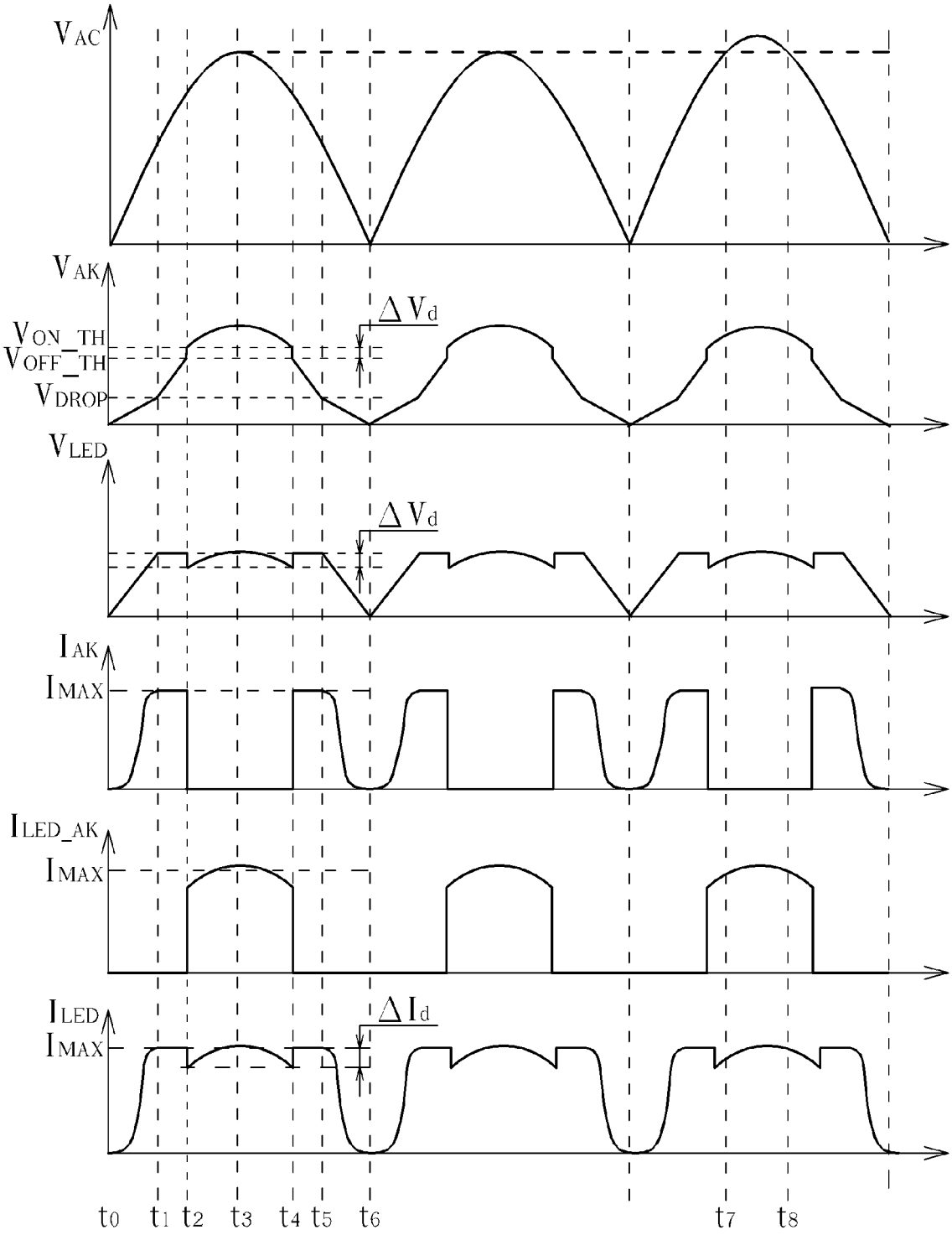

FIGS. 11 and 12 illustrate the operation of the LED lighting devices 300 and 400, wherein FIG. 11 is a diagram illustrating the current-voltage chart of the two-terminal current controller 120, and FIG. 12 is a diagram illustrating the variations in the related current and voltage when operating the LED lighting devices 300 and 400. In FIG. 11, the vertical axis represents the current $I_{AK}$ passing through the two-terminal current controller 120, and the horizontal axis represents the voltage $V_{AK}$ established across the two-terminal current controller 120.

During the rising period of the rectified voltage $V_{AC}$, the two-terminal current controller 120 operates in the first mode and functions as a voltage-controlled device when $0<V_{AK}<V_{DROP}$. In other words, when the voltage $V_{AK}$ exceeds the barrier voltage Vb' of the two-terminal current controller 120, the current $I_{AK}$ changes with the voltage $V_{AK}$ in a specific manner; the two-terminal current controller 120 operates in the second mode and functions as a constant current source when $V_{DROP}<V_{AK}<V_{OFF_TH}$. In other words, the current $I_{AK}$ is maintained at a maximum current $I_{MAX}$ instead of changing with the voltage $V_{AK}$; the two-terminal current controller 120 operates in the third mode and is turned off when $V_{AK}>V_{OFF_TH}$. In other words, the two-terminal current controller 120 functions as an open-circuited device since the current $I_{AK}$ is suddenly reduced to zero.

During the falling period of the rectified voltage $V_{AC}$, the two-terminal current controller 120 is turned on and operates in the second mode for limiting the current $I_{AK}$ to the maximum current $I_{MAX}$ when $V_{DROP}<V_{AK}<V_{ON_TH}$; the two-terminal current controller 120 operates in the first mode and functions as a voltage-controlled device when $0<V_{AK}<V_{DROP}$. In other words, when the voltage $V_{AK}$ exceeds the barrier voltage Vb' of the two-terminal current controller 120, the current $I_{AK}$ changes with the voltage $V_{AK}$ in a specific manner.

FIG. 12 illustrates the waveforms of the voltage $V_{AC}$, $V_{AK}$, $V_{LED}$ and the current $I_{AK}$, $I_{LED_AK}$ and $I_{LED}$. Since the rectified AC voltage $V_{AC}$ varies periodically with time, a cycle between $t_0$-$t_6$ is used for illustration, wherein the period between $t_0$-$t_3$ is the rising period of the rectified AC voltage $V_{AC}$ and the period between $t_3$-$t_6$ is the falling period of the rectified AC voltage $V_{AC}$. In most applications, m and n are large numbers so as to provide sufficient luminance. Therefore, the impedance device ZL experiences a voltage drop much smaller than that established across the luminescent device 21 or 25. For ease of illustration, assume that the voltage established across the impedance device ZL is negligibly small compared to $V_{AK}$ or $V_{LED}$. Between $t_0$-$t_1$, the voltage $V_{AK}$ established across the two-terminal current controller 120 and the voltage $V_{LED}$ established across the n serially-coupled light-emitting units $D_1$-$D_n$ increase with the rectified AC voltage $V_{AC}$. Due to smaller barrier voltage, the two-terminal current controller 120 is first turned on, after which the current $I_{AK}$ and the current $I_{LED}$ increase with the voltage $V_{AK}$ in a specific manner and the current $I_{LED_AK}$ is maintained at substantially zero.

Between $t_1$-$t_2$ when the voltage $V_{AK}$ is larger than the voltage $V_{DROP}$, the two-terminal current controller 120 is configured to limit the current $I_{AK}$ to the maximum current $I_{MAX}$, and the current $I_{LED}$ remains substantially zero since the luminescent device 21 is still turned off. With $V_F$ representing the forward-bias voltage of each light-emitting unit in the luminescent device 25, the value of the voltage $V_{LED}$ may be represented by $m*V_F$. Therefore, the luminescent device 21 is not conducting between $t_0$-$t_2$, and the rectified AC voltage $V_{AC}$ provided by the power supply circuit 110 is applied to the two-terminal current controller 120 and the n light-emitting units in the luminescent device 25, depicted as follows:

$$V_{AC}=V_{AK}+V_{LED} \tag{1}$$

Between $t_2$-$t_4$ when the voltage $V_{AK}$ is larger than the voltage $V_{OFF_TH}$, the two-terminal current controller 120 is turned off and the current associated with the rectified AC voltage $V_{AC}$ thus passes through the luminescent elements 21 and 25. The current $I_{AK}$ is reduced to zero, and the current $I_{LED_AK}$ changes with the voltage $V_{AK}$. Therefore, when the two-terminal current controller 120 is conducting between $t_2$ and $t_4$, the voltage $V_{AK}$ established across the two-terminal current controller 120 is supplied as the luminescent devices 21 and 25 performs voltage dividing on the rectified AC voltage $V_{AC}$, depicted as follows:

$$V_{AK} = \frac{m}{m+n} \times V_{AC} \tag{2}$$

Between $t_4$-$t_5$ when the voltage $V_{AK}$ drops to a value between the voltage $V_{DROP}$ and the voltage $V_{ON_TH}$, the two-terminal current controller 120 is turned on, thereby limiting the current $I_{AK}$ to the maximum current $I_{MAX}$ and maintaining the current $I_{LED_AK}$ at substantially zero. Between $t_5$-$t_6$ when the voltage $V_{AK}$ drops below the voltage $V_{DROP}$, the current $I_{AK}$ decreases with the voltage $V_{AK}$ in a specific manner. As depicted, the value of the current $I_{LED}$ is the sum of the current $I_{LED_AK}$ and the current $I_{AK}$. The two-terminal current controller 120 according to the present invention may increase the effective operational voltage range (such as the output of the rectified AC voltage $V_{AC}$ during $t_1$-$t_2$ and $t_4$-$t_5$), thereby increasing the power factor of the LED lighting device 300 and 400.

In the third and fourth embodiment of the present invention, the moment when the two-terminal current controller 120 is switched on or switched off, the voltage $V_{AK}$ and the voltage $V_{LED}$ both encounter a sudden voltage drop $\Delta V_d$, which results in a current fluctuation $\Delta I_d$. The voltage drop $\Delta V_d$ may be represented as follows:

$$\Delta V_d=V_{ON_TH}-V_{OFF_TH} \tag{3}$$

According to equation (1), prior to $t_2$ at the time when the voltage $V_{AK}$ reaches the voltage $V_{OFF_TH}$, the rectified AC voltage $V_{AC}$ may be represented as follows:

$$V_{AC}=V_{OFF_TH}+n*V_F \tag{4}$$

According to equation (2), prior to $t_4$ at the time when the voltage $V_{AK}$ reaches the voltage $V_{ON_TH}$, the rectified AC voltage $V_{AC}$ may be represented as follows:

$$V_{AK} = V_{ON_TH} = \frac{m}{m+n} \times V_{AC} \tag{5}$$

Introducing equation (4) into equation (5) results in:

$$V_{ON_TH} = \frac{m}{m+n} \times (V_{OFF_TH} + n \times V_F) \tag{6}$$

Introducing equation (6) into equation (3) results in:

$$V_d = \frac{m \times n}{m+n} \times V_F - \frac{n}{m+n} \times V_{OFF,TH} \tag{7}$$

In actual applications, the value of the voltage $V_{OFF_TH}$ may be determined according to the maximum power dissipation $P_{D_MAX}$ and the maximum output current $I_{MAX}$ of the two-terminal current controller 120, depicted as follows:

$$P_{D_MAX}=V_{OFF_TH}*I_{MAX} \quad (8)$$

According to equations (7) and (8), the voltage drop $\Delta V_d$ may be adjusted by changing m and n. For example, for the same amount (m+n) of the light-emitting units in the luminescent devices 21 and 25, the voltage drop $\Delta V_d$ may be reduced by choosing a larger value of n, thereby providing a more stable driving current $I_{LED}$.

Figure 13:
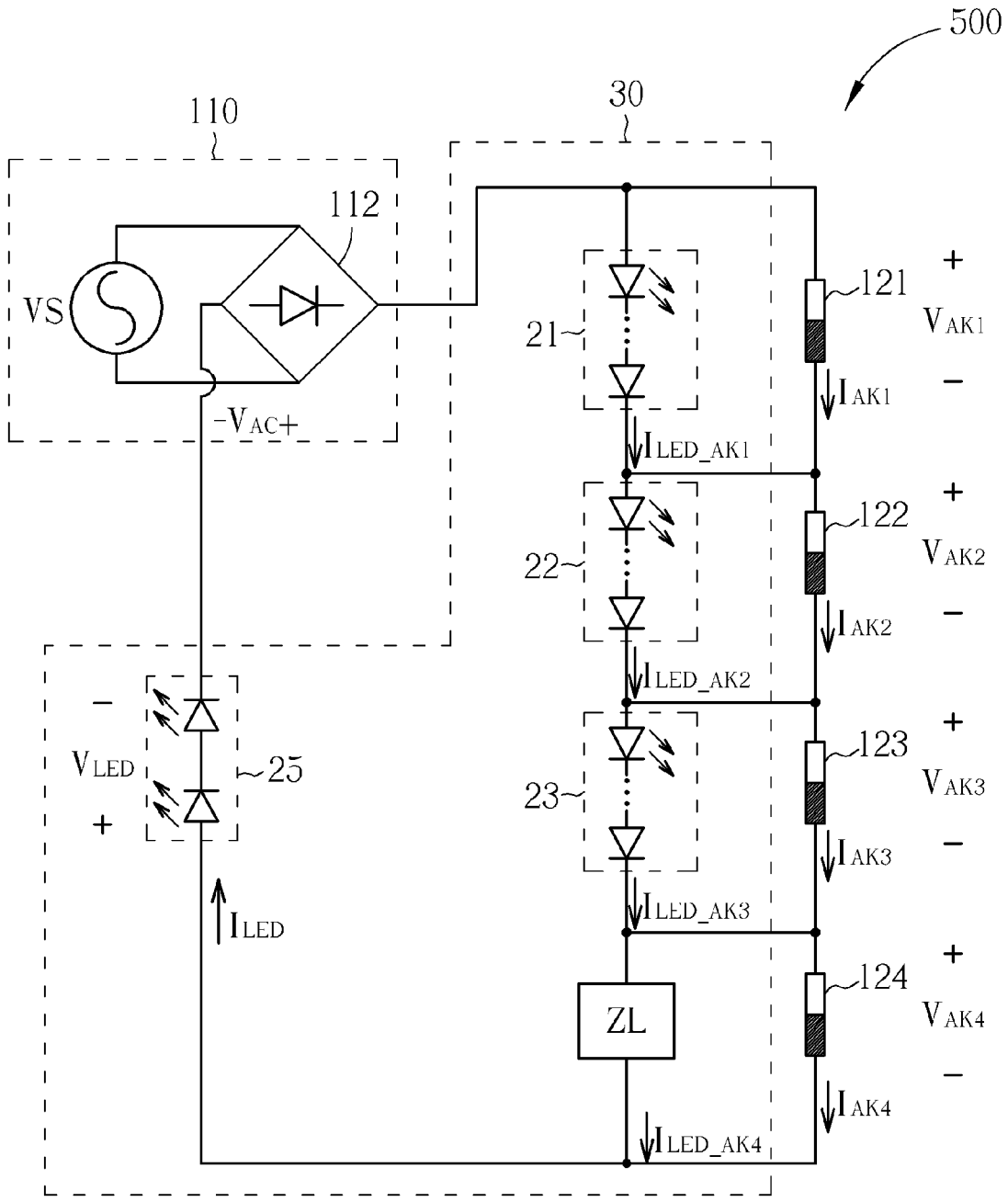
Figure 14:
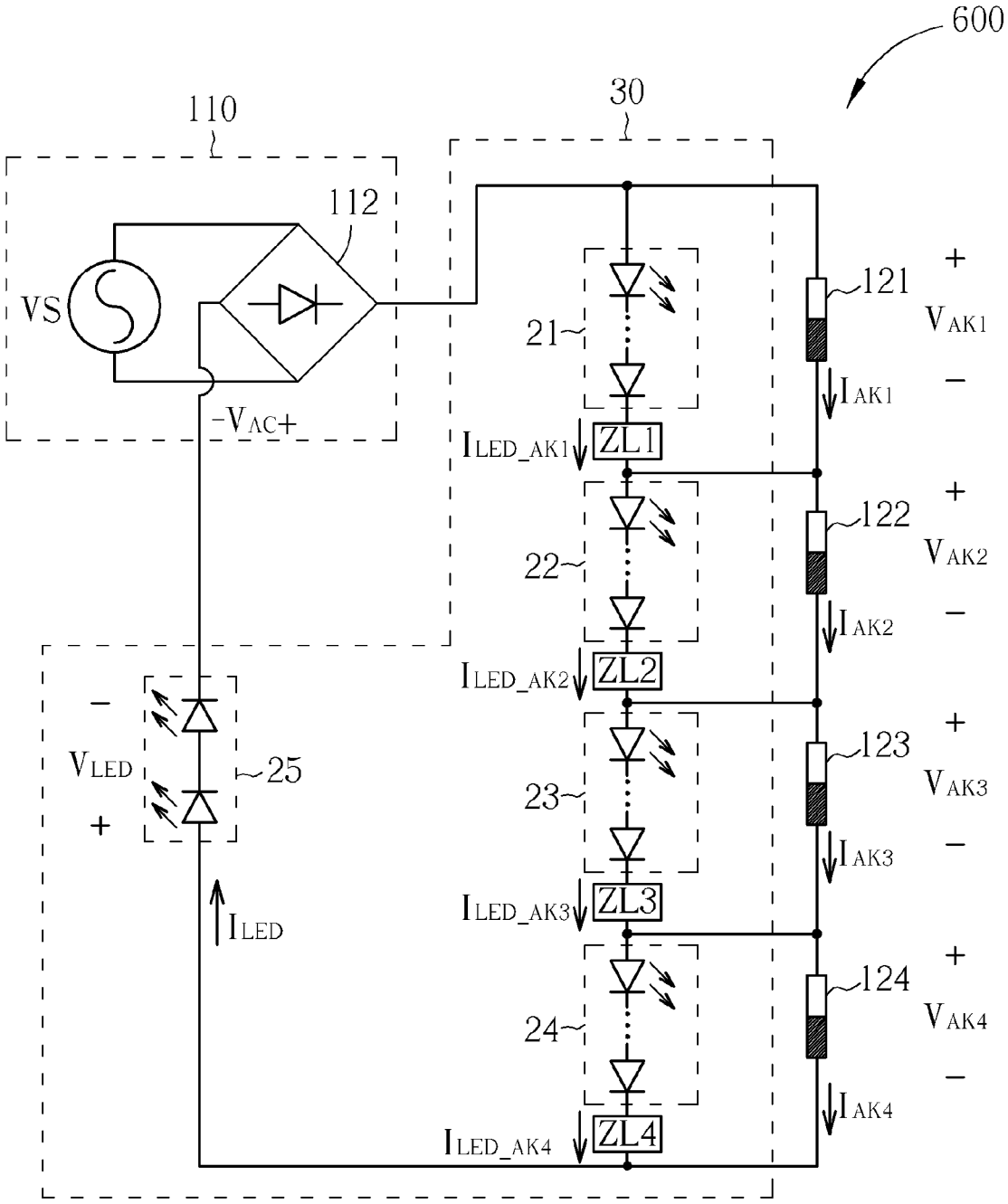
Figure 15:
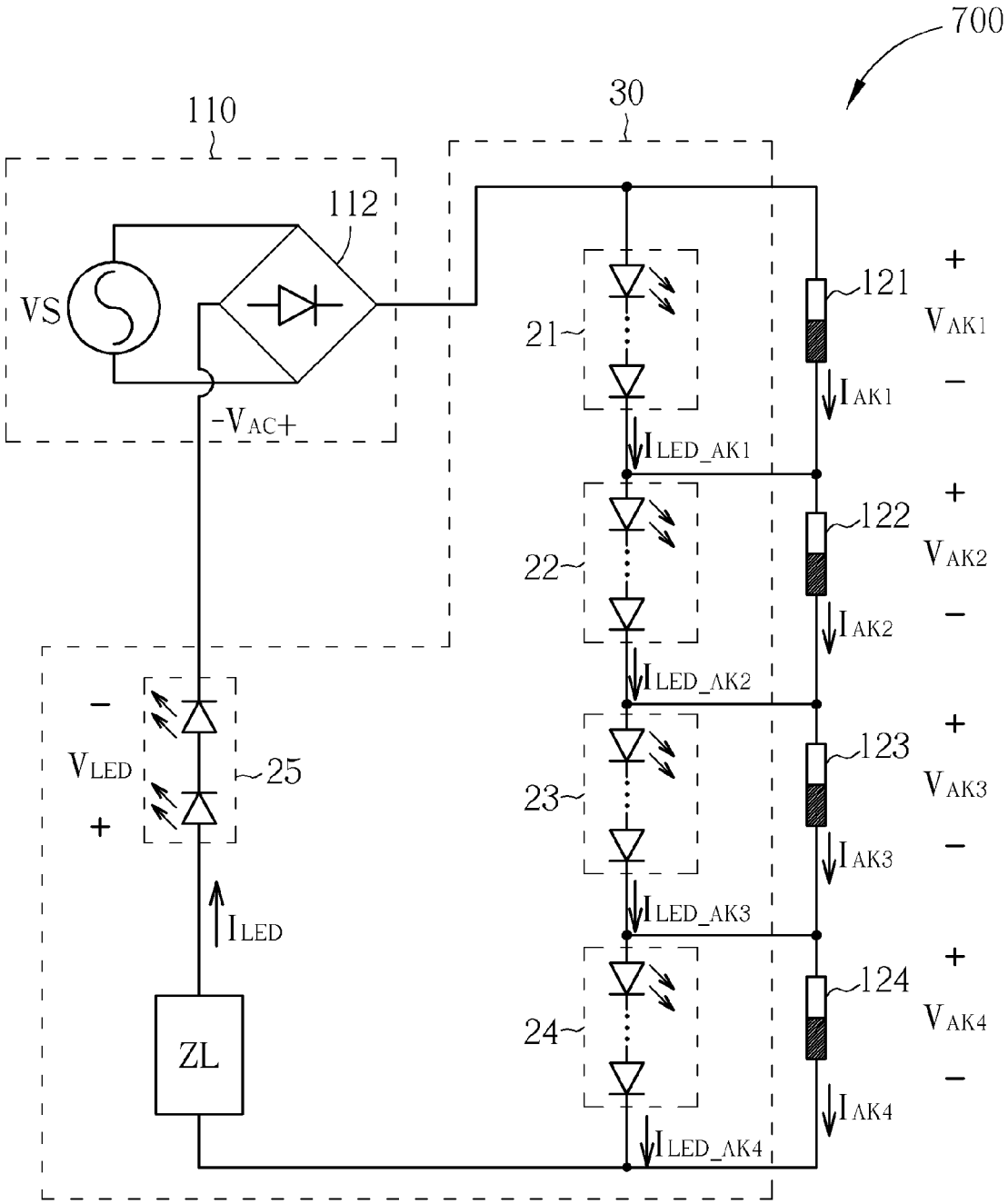
Figure 16:
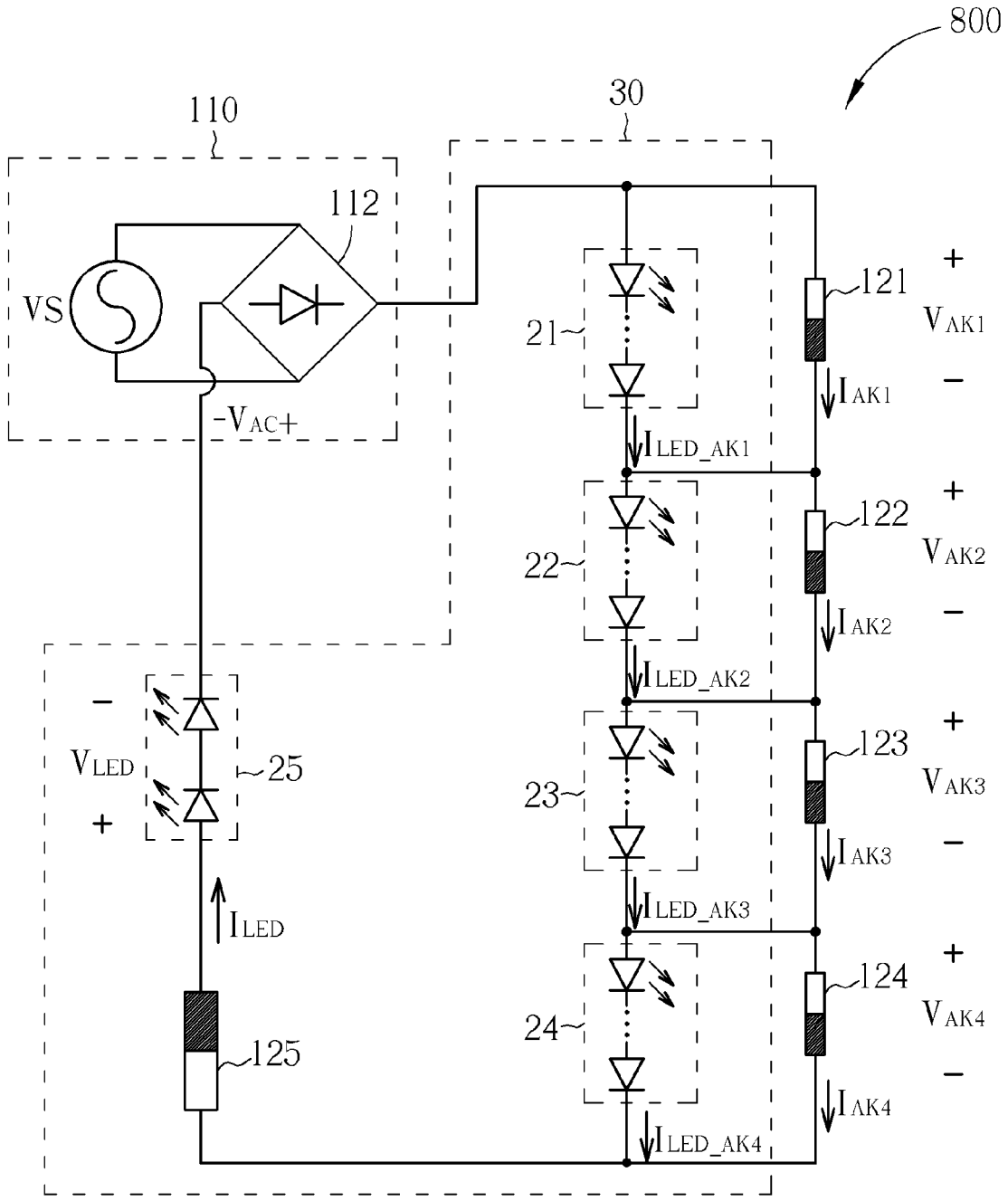

FIG. 13 is a diagram of an LED lighting device 500 according to a fifth embodiment of the present invention. FIG. 14 is a diagram of an LED lighting device 600 according to a sixth embodiment of the present invention. FIG. 15 is a diagram of an LED lighting device 700 according to a seventh embodiment of the present invention. FIG. 16 is a diagram of an LED lighting device 800 according to an eighth embodiment of the present invention. Each of the LED lighting devices 500, 600, 700 and 800 includes a power supply circuit 110, a plurality of two-terminal current controllers, a plurality of luminescent devices, and at least one impedance device.

In the fifth embodiment of the present invention depicted in FIG. 13, the LED lighting device 500 includes 4 two-terminal current controllers 121-124, 4 luminescent devices 21-23, 25, and an impedance device ZL. The luminescent devices 21-23, respectively coupled in parallel to the corresponding two-terminal current controllers 121-123, each include a plurality of light-emitting units coupled in series, wherein $I_{LED_AK1}$-$I_{LED_AK3}$ respectively represent the currents flowing through the luminescent devices 21-23 and $V_{AK1}$-$V_{AK3}$ respectively represent the voltages established across the luminescent devices 21-23. The impedance device ZL, coupled in parallel to the corresponding two-terminal current controller 124, may include a resistor, a capacitor, any device providing a resistive path, or any combination thereof, wherein $I_{LED_AK4}$ represents the currents flowing through the impedance device ZL and $V_{AK4}$ represents the voltage established across the impedance device ZL. The luminescent device 25, coupled in series to the two-terminal current controllers 121-124, includes a plurality of light-emitting units coupled in series, wherein $I_{LED}$ represents the current flowing through the luminescent device 25 and $V_{LED}$ represents the voltage established across the luminescent device 25. Each light-emitting unit may include a single light-emitting diode or multiple light-emitting diodes, and FIG. 13 depicts the embodiment using a single light-emitting diode. In the embodiment shown in FIG. 13, the two-terminal current controllers 121-124 are configured to regulate the currents passing through the corresponding luminescent element elements 21-23 and the impedance device ZL according to the voltages $V_{AK1}$-$V_{AK4}$, respectively, wherein $I_{AK1}$-$I_{AK4}$ respectively represent the currents flowing through the two-terminal current controllers 121-124. The barrier voltages of the two-terminal current controllers 121-123 are smaller than the overall barrier voltages of the corresponding luminescent elements 21-23. If the power supply circuit 110 somehow fluctuates and the rectified AC voltage $V_{AC}$ is raised above its upper design limit, the impedance device ZL may provide overvoltage protection to the luminescent devices 21-23 and 25.

In the sixth embodiment of the present invention depicted in FIG. 14, the LED lighting device 600 includes 4 two-terminal current controllers 121-124, 5 luminescent devices 21-25, and 4 impedance devices ZL1-ZL4. The luminescent devices 21-24, respectively coupled in series to the corresponding impedance devices ZL1-ZL4 and respectively coupled in parallel to the corresponding two-terminal current controllers 121-124, each include a plurality of light-emitting units coupled in series, wherein $I_{LED_AK1}$-$I_{LED_AK4}$ respectively represent the currents flowing through the luminescent devices 21-24 and $V_{AK1}$-$V_{AK4}$ respectively represent the voltages established across the two-terminal current controllers 121-124. Each of the impedance devices ZL1-ZL4 may include a resistor, a capacitor, any device providing a resistive path, or any combination thereof. The luminescent device 25, coupled in series to the two-terminal current controllers 121-124, includes a plurality of light-emitting units coupled in series, wherein $I_{LED}$ represents the current flowing through the luminescent device 25 and $V_{LED}$ represents the voltage established across the luminescent device 25. Each light-emitting unit may include a single light-emitting diode or multiple light-emitting diodes, and FIG. 14 depicts the embodiment using a single light-emitting diode. In the embodiment shown in FIG. 14, the two-terminal current controllers 121-124 are configured to regulate the currents passing through the corresponding luminescent element elements 21-24 according to the voltages $V_{AK1}$-$V_{AK4}$, respectively, wherein $I_{AK1}$-$I_{AK4}$ respectively represent the currents flowing through the two-terminal current controllers 121-124. The barrier voltages of the two-terminal current controllers 121-124 are smaller than the overall barrier voltages of the corresponding luminescent devices 21-24. If the power supply circuit 110 somehow fluctuates and the rectified AC voltage $V_{AC}$ is raised above its upper design limit, the impedance devices ZL1-ZL4 may provide overvoltage protection to the luminescent devices 21-25. Meanwhile, the impedance devices ZL1-ZL4 may provide current paths of different resistances so that the luminescent devices 21-24 may be turned on in different sequences.

In the seventh embodiment of the present invention depicted in FIG. 15, the LED lighting device 700 includes 4 two-terminal current controllers 121-124, 5 luminescent devices 21-25, and one impedance device ZL. The luminescent devices 21-24, respectively coupled in parallel to the corresponding two-terminal current controllers 121-124, each include a plurality of light-emitting units coupled in series, wherein $I_{LED_AK1}$-$I_{LED_AK4}$ respectively represent the currents flowing through the luminescent devices 21-24 and $V_{AK1}$-$V_{AK4}$ respectively represent the voltages established across the luminescent devices 21-24. The impedance device ZL, coupled in series to the luminescent devices 21-25, may include a resistor, a capacitor, any device providing a resistive path, or any combination thereof. The luminescent device 25, coupled in series to the two-terminal current controllers 121-124, includes a plurality of light-emitting units coupled in series, wherein $I_{LED}$ represents the current flowing through the luminescent device 25 and $V_{LED}$ represents the voltage established across the luminescent device 25. Each light-emitting unit may include a single light-emitting diode or multiple light-emitting diodes, and FIG. 15 depicts the embodiment using a single light-emitting diode. In the embodiment shown in FIG. 15, the two-terminal current controllers 121-124 are configured to regulate the currents passing through the corresponding luminescent element devices 21-24 according to the voltages $V_{AK1}$-$V_{AK4}$, respectively, wherein $I_{AK1}$-$I_{AK4}$ respectively represent the currents flowing through the two-terminal current controllers 121-124. The barrier voltages of the two-terminal current controllers 121-124 are smaller than the overall barrier voltages of the corresponding luminescent devices 21-24. If the power supply circuit 110 somehow fluctuates and the rectified AC voltage $V_{AC}$ is raised above its upper design limit, the impedance device ZL may provide overvoltage protection to the luminescent devices 21-25.

In the eighth embodiment of the present invention depicted in FIG. 16, the LED lighting device 800 includes 5 two-terminal current controllers 121-125 and 5 luminescent devices 21-25. The luminescent devices 21-24, respectively coupled in parallel to the corresponding two-terminal current controllers 121-124, each include a plurality of light-emitting units coupled in series, wherein $I_{LED_AK1}$-$I_{LED_AK4}$ respectively represent the currents flowing through the luminescent devices 21-24 and $V_{AK1}$-$V_{AK4}$ respectively represent the voltages established across the luminescent devices 21-24. The two-terminal current controller 125, coupled in series to the luminescent devices 21-25, may function as an impedance device (or a current regulator). The luminescent device 25, coupled in series to the two-terminal current controllers 121-125, includes a plurality of light-emitting units coupled in series, wherein $I_{LED}$ represents the current flowing through the luminescent device 25 and $V_{LED}$ represents the voltage established across the luminescent device 25. Each light-emitting unit may include a single light-emitting diode or multiple light-emitting diodes, and FIG. 16 depicts the embodiment using a single light-emitting diode. In the embodiment shown in FIG. 16, the two-terminal current controllers 121-124 are configured to regulate the currents passing through the corresponding luminescent element devices 21-24 according to the voltages $V_{AK1}$-$V_{AK4}$, respectively, wherein $I_{AK1}$-$I_{AK4}$ respectively represent the currents flowing through the two-terminal current controllers 121-124. The barrier voltages of the two-terminal current controllers 121-124 are smaller than the overall barrier voltages of the corresponding luminescent devices 21-24. If the power supply circuit 110 somehow fluctuates and the rectified AC voltage $V_{AC}$ is raised above its upper design limit, the two-terminal current controller 125 may function as a current regulator to clamp the current at a predetermined value, thereby capable of absorbing the redundant voltage to provide overvoltage protection to the luminescent devices 21-25.

Figure 17:
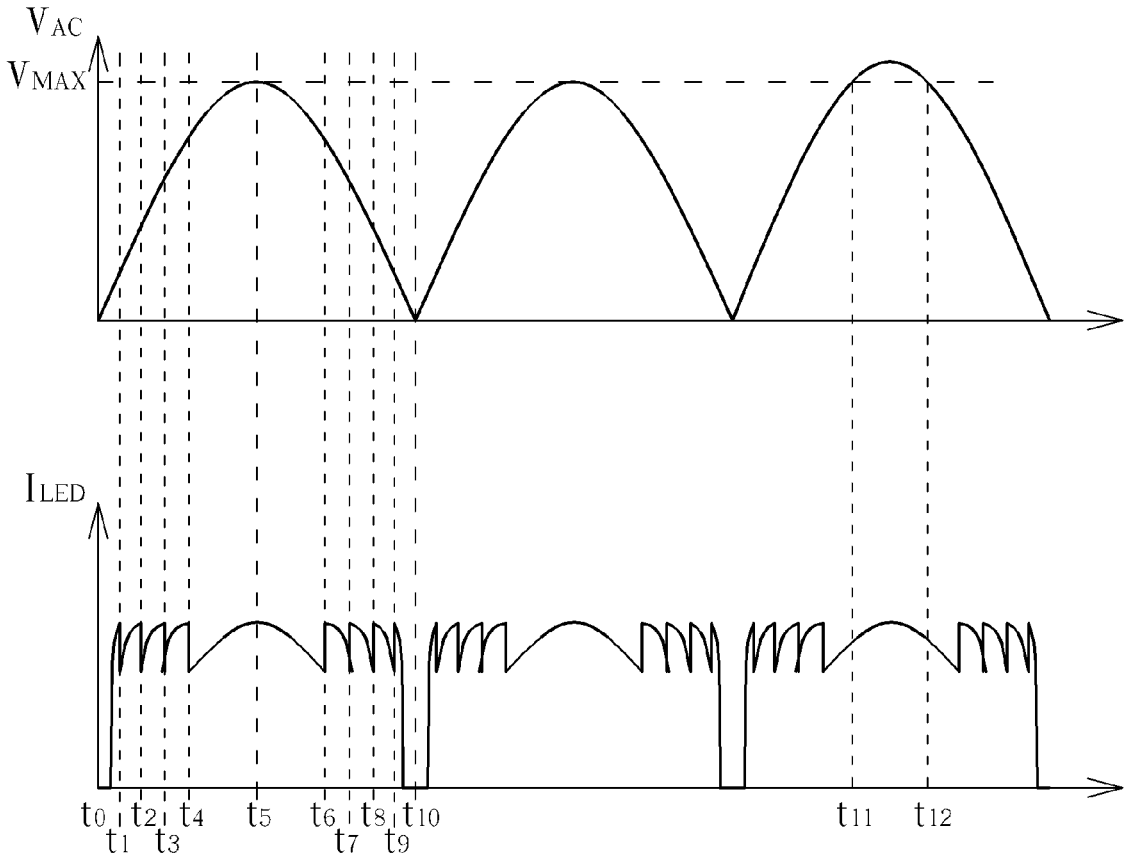
FIG. 17 is a diagram illustrating the operation of the LED lighting devices according to the present invention

Reference may also be made to FIG. 11 for the current-voltage chart of each two-terminal current controller in the LED lighting devices 500, 600, 700 and 800. The values of $V_{DROP1}$-$V_{DROP4}$, $V_{OFF_TH1}$-$V_{OFF_TH4}$ and $V_{ON_TH1}$-$V_{ON_TH4}$ may be determined according to the maximum power dissipation and the maximum output current of the two-terminal current controllers 121-124, as well as the characteristics and the amount of the light-emitting diodes in use. FIG. 17 is a diagram illustrating the operation of the LED lighting devices 500, 600, 700 and 800 according to the present invention. Since the rectified AC voltage $V_{AC}$ varies periodically with time, a cycle between $t_0$-$t_{10}$ is used for illustration, wherein the period between $t_0$-$t_5$ is the rising period of the rectified AC voltage $V_{AC}$ and the period between $t_5$-$t_{10}$ is the falling period of the rectified AC voltage $V_{AC}$.

The operation of the LED lighting devices 500, 600, 700 and 800 during the rising period $t_0$-$t_5$ is hereby explained. Between $t_0$-$t_1$ when the voltages $V_{AK1}$-$V_{AK4}$ increase with the rectified voltage $V_{AC}$, the two-terminal current controllers 121-124 are turned on earlier due to smaller barrier voltages, and the current flows from the power supply circuit 110 to the luminescent device 25 sequentially via the two-terminal current controllers 121-124 (i.e., $I_{LED}=I_{AK1}=I_{AK2}=I_{AK3}=I_{AK4}$ and $I_{LED_AK1}=I_{LED_AK2}=I_{LED_AK3}=I_{LED_AK4}\approx 0$). Between $t_1$-$t_2$ when the voltage $V_{AK1}$ is larger than the voltage $V_{OFF_TH1}$, the two-terminal current controller 121 is turned off first, and the current flows from the power supply circuit 110 to the luminescent device 25 sequentially via the luminescent device 21 and the two-terminal current controllers 122-124 (i.e., $I_{LED}=I_{LED_AK1}=I_{AK2}=I_{AK3}=I_{AK4}$ and $I_{AK1}=I_{LED_AK2}=I_{LED_AK3}=I_{LED_AK4}\approx 0$). Between $t_2$-$t_3$ when the voltage $V_{AK2}$ is larger than the voltage $V_{OFF_TH2}$, the two-terminal current controller 122 is turned off next, and the current flows from the power supply circuit 110 to the luminescent device 25 sequentially via the luminescent device 21, the luminescent device 22 and the two-terminal current controllers 123-124 (i.e., $I_{LED}=I_{LED_AK1}=I_{LED_AK2}=I_{AK3}=I_{AK4}$ and $I_{AK1}=I_{AK2}=I_{LED_AK3}=I_{LED_AK4}\approx 0$). Between $t_3$-$t_4$ when the voltage $V_{AK3}$ is larger than the voltage $V_{OFF_TH3}$, the two-terminal current controller 123 is turned off next, and the current flows from the power supply circuit 110 to the luminescent device 25 sequentially via the luminescent device 21, the luminescent device 22, the luminescent device 23 and the two-terminal current controller 124. Between $t_4$-$t_5$ when the voltage $V_{AK4}$ is larger than the voltage $V_{OFF_TH4}$, the two-terminal current controller 124 is turned off next, and the current flows from the power supply circuit 110 to the luminescent device 25 sequentially via the luminescent devices 21-23 or the luminescent devices 21-24. During the falling period $t_5$-$t_{10}$, when the voltages $V_{AK4}$-$V_{AK1}$ sequentially drop below $V_{ON_TH4}$-$V_{ON_TH1}$, respectively, the two-terminal current controllers 124-121 are sequentially turned on at $t_6$-$t_9$, respectively. The operation of the LED lighting devices 500, 600, 700 and 800 during the falling period $t_5$-$t_{10}$ is similar to that during the corresponding rising period $t_0$-$t_5$ as previously illustrated.

If the power supply circuit 110 somehow fluctuates and the rectified AC voltage $V_{AC}$ is raised above its upper design limit $V_{MAX}$ (such as during $t_{11}$-$t_{12}$), the overvoltage may cause overcurrent to damage the luminescent devices 21-25 and create extra heat. The impedance device ZL or ZL1-ZL4 and the two-terminal current controller 125 may function as a current limiter which prevents the luminescent device 21-25 from possible damages due to overcurrent and may also improve heat dissipation.

Figure 18:
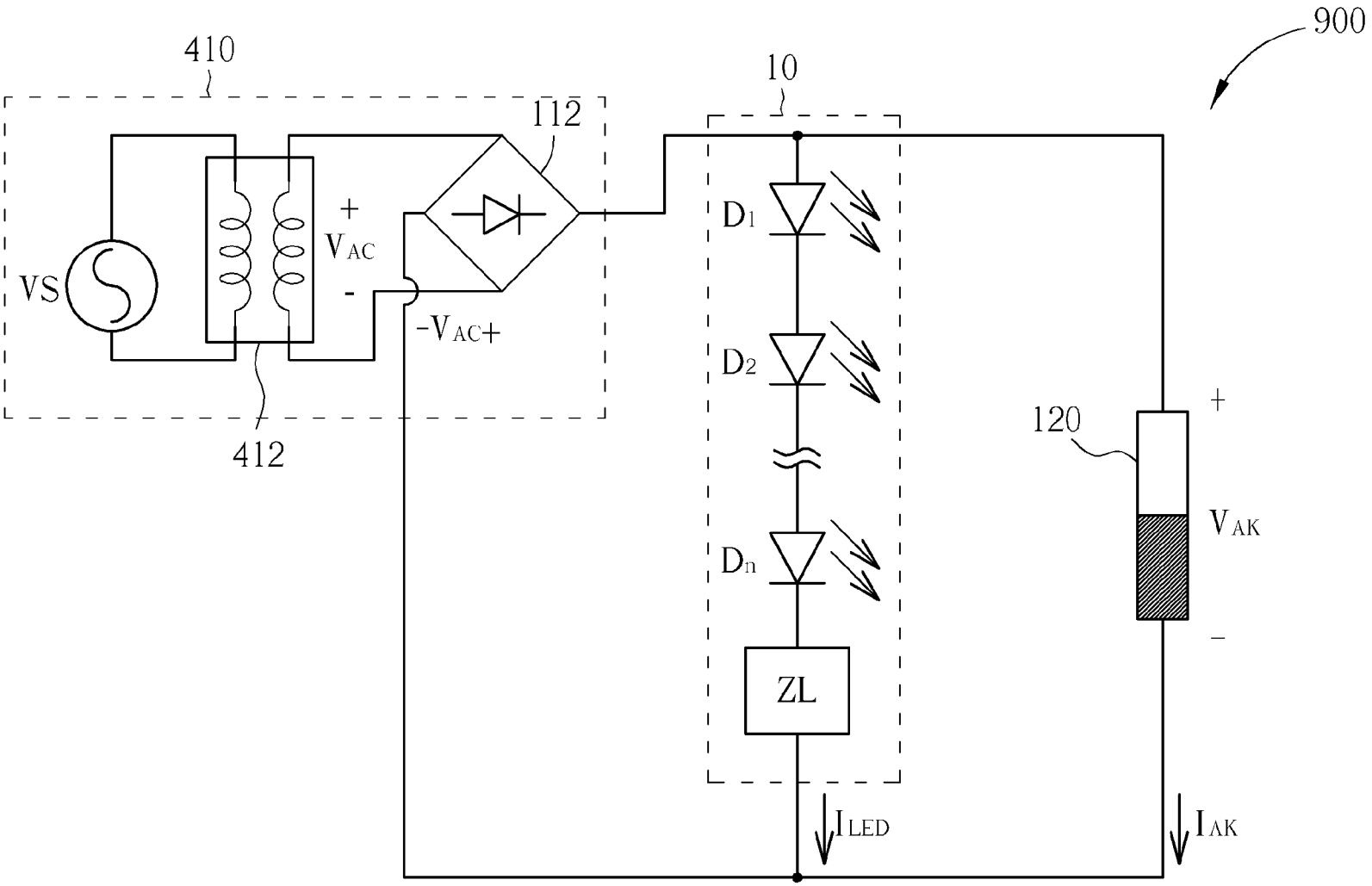

FIG. 18 is a diagram illustrating an LED lighting device 900 according to a ninth embodiment of the present invention. The LED lighting device 900 includes a power supply circuit 410, a two-terminal current controller 120, and a luminescent device 10. Having similar structures, the first and ninth embodiments of the present invention differ in the power supply circuits. In the first embodiment of the present invention, the power supply circuit 110 is configured to rectify the AC voltage VS (such as 110-220V main) using the bridge rectifier 112, thereby providing the rectified AC voltage $V_{AC}$ whose value varies periodically with time. In the ninth embodiment of the present invention, the power supply circuit 410 is configured to receive any AC voltage VS, perform voltage conversion using an AC-AC converter 412, and rectify the converted AC voltage VS using the bridge rectifier 112, thereby providing the rectified AC voltage $V_{AC}$ whose value varies periodically with time. References may be also be made to FIGS. 6 and 7 for illustrating the operation of the LED lighting device 900. Similarly, the second to eighth embodiments of the present invention may also use the power supply circuit 410 for providing the rectified AC voltage $V_{AC}$.

In the LED lighting devices 100, 200, 300, 400, 500, 600, 700, 800 and 900 of the present invention, the number of the two-terminal current controllers 120-125, the number and configuration of the luminescent elements 21-25, and the type of the power supply circuits 110 and 410 may be determined according to different applications. FIGS. 4-5, 8-10, 13-16 and 18 are merely for illustrative purpose and do not limit the scope of the present invention. Also, the two-terminal current controller 120 depicted in FIG. 8 is an embodiment of the present invention and may be substituted by devices which are able to provide characteristics as shown in FIGS. 6-7, 11-12 and 17.

In each of the LED lighting devices according to the embodiments of the present invention, the two-terminal current controller(s), the luminescent elements, and the impedance device(s) may be disposed on the same circuit board in a single assembly step.

The LED lighting device of the present invention is configured to regulate the current flowing through the serially-coupled light-emitting diodes and control the number of the turned-on light-emitting diodes using a two-terminal current controller. Some of the light-emitting diodes may be conducted before the rectified AC voltage reaches the overall barrier voltage of all light-emitting diodes for improving the power factor. Also, one or more impedance devices may be used for providing overvoltage protection, improving heat dissipation or adjusting the turn-on sequence of the light-emitting diodes. Therefore, the present invention may provide LED lighting devices with large effective operational voltage range and overvoltage protection.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light-emitting diode (LED) lighting device with overvoltage protection, comprising:

a first luminescent device for providing light according to a first current;

a second luminescent device coupled in series to the first luminescent device for providing light according to a second current;

a first impedance device for limiting the first current or the second current within a first predetermined range when a voltage established across the first luminescent device and the second luminescent device exceeds a first predetermined value;

a first two-terminal current controller coupled in parallel to the first luminescent device and in series to the second luminescent device and configured to regulate the second current according to a voltage established across the two-terminal current controller, wherein:

during a rising period of a rectified alternative-current (AC) voltage when the voltage established across the first luminescent device does not exceed a first voltage, the first two-terminal current controller operates in a first mode;

during the rising period when the voltage established across the first luminescent device exceeds the first voltage but does not exceed a second voltage, the first two-terminal current controller operates in a second mode;

during the rising period when the voltage established across the first luminescent device exceeds the second voltage, the first two-terminal current controller operates in a third mode; and the first two-terminal current controller includes:

a current limiting unit configured to:

conduct a third current associated with the rectified AC voltage, regulate the third current according to the voltage established across the first luminescent device and maintain the first current at zero when the first two-terminal current controller operates in the first mode;

conduct the third current, maintain the third current at a second predetermined value larger than zero and maintain the first current at zero when the first two-terminal current controller operates in the second mode; and switch off for equalizing the first current and the second current when the first two-terminal current controller operates in the third mode.

2. The LED lighting device of claim 1, wherein when the voltage established across the first two-terminal current controller is larger than the first voltage and does not exceed a third voltage during a falling period of the rectified AC voltage, the first two-terminal current controller is turned on for maintaining the first current at substantially zero and setting the second current and the third current to the second predetermined value, and the third voltage is larger than the second voltage.

3. The LED lighting device of claim 2, wherein the first two-terminal current controller comprises:

a switch configured to conduct the third current according to a turn-on voltage;

a control circuit configured to provide the turn-on voltage according to a first control signal and a second control signal;

a current-detecting circuit configured to determine whether the voltage established across the first two-terminal current controller is larger than the first voltage according to the third current, thereby providing the first control signal accordingly; and a voltage-detecting circuit configured to determine relationships between the voltage established across the first two-terminal current controller, the second voltage and the third voltage, identify the corresponding rising or falling period, and provide the second control signal accordingly.

4. The LED lighting device of claim 3, wherein:

when the current-detecting circuit determines that the voltage established across the first two-terminal current controller does not exceed the first voltage, the switch regulates the third current according to the turn-on voltage; and when the current-detecting circuit determines that the voltage established across the first two-terminal current controller is larger than the first voltage, the switch limits the third current to the second predetermined value according to the turn-on voltage.

5. The LED lighting device of claim 3, wherein:

when the voltage-detecting circuit determines that the voltage established across the first two-terminal current controller is larger than the first voltage and does not exceed the second voltage during the rising period, the switch limits the third current to the second predetermined value according to the turn-on voltage and maintains the first current at substantially zero; and when the voltage-detecting circuit determines that the voltage established across the first two-terminal current controller is larger than the first voltage and does not exceed the third voltage which is larger than the second voltage during the falling period, the switch limits the third current to the second predetermined value according to the turn-on voltage and maintains the first current at substantially zero.

6. The LED lighting device of claim 3, wherein the first two-terminal current controller is configured to regulate the third current according to the voltage established across the first two-terminal current controller, so that a relationship between the voltage established across the first two-terminal current controller and the third current matches a characteristic when the switch operates in a specific operational region.

7. The LED lighting device of claim 1, wherein a barrier voltage for turning on the first two-terminal current controller is smaller than a barrier voltage for turning on the first luminescent device.

8. The LED lighting device of claim 1, wherein each luminescent device includes a plurality of LEDs coupled in series.

9. The LED lighting device of claim 1, wherein the first impedance device includes a resistor or a capacitor.

10. The LED lighting device of claim 1, wherein the first impedance device is coupled in series to the first luminescent device and the second luminescent device.

11. The LED lighting device of claim 10, wherein the first two-terminal current controller is coupled in parallel to the serially-coupled first luminescent device and the first impedance device.

12. The LED lighting device of claim 10, further comprising:

a second two-terminal current controller coupled in series to the first two-terminal current controller and the second luminescent device and configured to regulate the second current according to a voltage established across the second two-terminal current controller, wherein the first impedance device is coupled in parallel to the second two-terminal current controller.

13. The LED lighting device of claim 1, further comprising:

a third luminescent device coupled in series to the first luminescent device and the second luminescent device for providing light according to a fourth current;

a second two-terminal current controller coupled in parallel to the third luminescent device and in series to the first two-terminal current controller and the second luminescent device and configured to regulate the second current according to a voltage established across the second two-terminal current controller;

a second impedance device for limiting the fourth current within a second predetermined range when a voltage established across the first to third luminescent devices exceeds a second predetermined value, wherein:

the first impedance device is coupled in parallel to the first two-terminal current controller and coupled in series to the first luminescent device; and the second impedance device is coupled in parallel to the second two-terminal current controller and coupled in series to the second luminescent device.

14. The LED lighting device of claim 10, wherein the first impedance device comprises:

a second two-terminal current controller coupled in series to the first two-terminal current controller and configured to regulate the second current according to a voltage established across the second two-terminal current controller.

15. The LED lighting device of claim 1 further comprising a power supply circuit configured to provide the rectified AC voltage for driving the first luminescent device and the second luminescent device.

16. The LED lighting device of claim 15 wherein the power supply circuit includes an AC-AC voltage converter.

17. The LED lighting device of claim 1, wherein the first luminescent device, the second luminescent device, the first impedance device and the first two-terminal current controller are disposed on a same circuit board.

* * * * *